US005441545A

United States Patent [19]

Lewtas et al.

[11] Patent Number: 5,441,545

[45] Date of Patent: Aug. 15, 1995

[54] MIDDLE DISTILLATE COMPOSITIONS WITH IMPROVED LOW TEMPERATURE PROPERTIES

[75] Inventors: Kenneth Lewtas, Wantage; Robert D. Tack, Oxford; Jacqueline D. Bland, Wantage, all of United Kingdom; Albert Rossi, Warren, N.J.

[73] Assignee: Exxon Chemical Patents Inc., Linden, N.J.

[21] Appl. No.: 88,630

[22] Filed: Jul. 6, 1993

Related U.S. Application Data

[63] Continuation of Ser. No. 731,685, Jul. 17, 1991, abandoned, which is a continuation of Ser. No. 509,977, Apr. 16, 1990, abandoned, which is a continuation of Ser. No. 356,544, May 24, 1989, abandoned, which is a continuation of Ser. No. 901,233, Aug. 28, 1986, abandoned.

[30] Foreign Application Priority Data

Aug. 28, 1985 [GB] United Kingdom ..... 8521393

[51] Int. Cl.[6] ..... C10L 1/18

[52] U.S. Cl. ..... 44/393; 44/394; 44/395

[58] Field of Search ..... 44/393, 394, 395

[56] References Cited

U.S. PATENT DOCUMENTS

| | | | |
|---|---|---|---|
| 2,542,542 | 2/1951 | Lippincott et al. | 252/56 |
| 2,655,479 | 10/1953 | Munday et al. | 252/56 |
| 2,824,840 | 2/1958 | Cashman et al. | 252/56 |
| 3,048,479 | 8/1962 | Ilnyckyj et al. | 44/62 |
| 3,252,771 | 5/1966 | Clough et al. | 44/62 |
| 3,413,103 | 11/1968 | Young et al. | 44/62 |
| 3,477,916 | 6/1969 | Edwards | 44/70 |
| 3,632,510 | 1/1972 | Monroe | 44/70 |
| 3,726,653 | 4/1973 | van der Meij et al. | 44/62 |
| 3,729,296 | 4/1973 | Miller | 44/62 |
| 3,961,916 | 6/1976 | Ilnyckyj et al. | 44/62 |
| 3,981,850 | 9/1976 | Wisotsky et al. | 526/227 |
| 4,036,772 | 7/1977 | Dorer, Jr. | 44/70 |
| 4,074,978 | 2/1978 | Panzer | 44/62 |
| 4,113,442 | 9/1978 | Hoff et al. | 44/70 |
| 4,135,887 | 1/1979 | Rossi | 44/70 |
| 4,153,422 | 5/1979 | Wisotsky | 44/62 |
| 4,153,424 | 5/1979 | Wisotsky | 44/62 |
| 4,175,926 | 11/1979 | Wisotsky | 44/62 |
| 4,211,534 | 7/1980 | Feldman | 44/62 |
| 4,240,916 | 12/1980 | Rossi | 252/56 D |
| 4,255,160 | 3/1981 | Pappas et al. | 44/70 |
| 4,261,703 | 4/1981 | Tack et al. | 44/62 |
| 4,375,973 | 3/1983 | Rossi et al. | 44/70 |
| 4,491,455 | 1/1985 | Ishizaki et al. | 44/62 |
| 4,661,121 | 4/1987 | Lewtas | 44/70 |
| 4,661,122 | 4/1987 | Lewtas | 44/70 |
| 4,713,088 | 12/1987 | Tack et al. | 44/62 |
| 5,330,545 | 7/1994 | Lewtas et al. | 44/393 |

FOREIGN PATENT DOCUMENTS

| | | | |
|---|---|---|---|
| 061895A2 | 6/1982 | European Pat. Off. . | |
| 0061895 | 10/1982 | European Pat. Off. . | |
| 55-40640 | 10/1980 | Japan . | |
| 56-54037 | 12/1981 | Japan . | |
| 56-54038 | 12/1981 | Japan . | |
| 101194 | 5/1985 | Japan . | |
| 60-101194 | 5/1985 | Japan | 44/70 |
| 1263152 | 2/1972 | United Kingdom . | |
| 1317899 | 5/1973 | United Kingdom | C10L 1/18 |
| 1468588 | 3/1977 | United Kingdom . | |
| 1469016 | 3/1977 | United Kingdom . | |
| 2129012 | 9/1985 | United Kingdom . | |

*Primary Examiner*—Jerry D. Johnson
*Attorney, Agent, or Firm*—John J. Mahon

[57] ABSTRACT

Copolymers of straight chain alpha olefins and maleic anhydride esterified with an alcohol wherein the alpha olefin is of the formula:

$$R.CH=CH_2$$

and the alcohol is of the formula:

$$R^1OH$$

in which at least one of R and $R^1$ is greater than 10 and the sum of R and $R^1$ is from 18 to 38 and $R^1$ is linear or contains a methyl branch at the 1 or 2 position have been found to be effective additives for improving the low temperature properties of distillate fuels.

7 Claims, 18 Drawing Sheets

MIDDLE DISTILLATE COMPOSITIONS WITH IMPROVED LOW TEMPERATURE PROPERTIES

Figures 1, 1A:
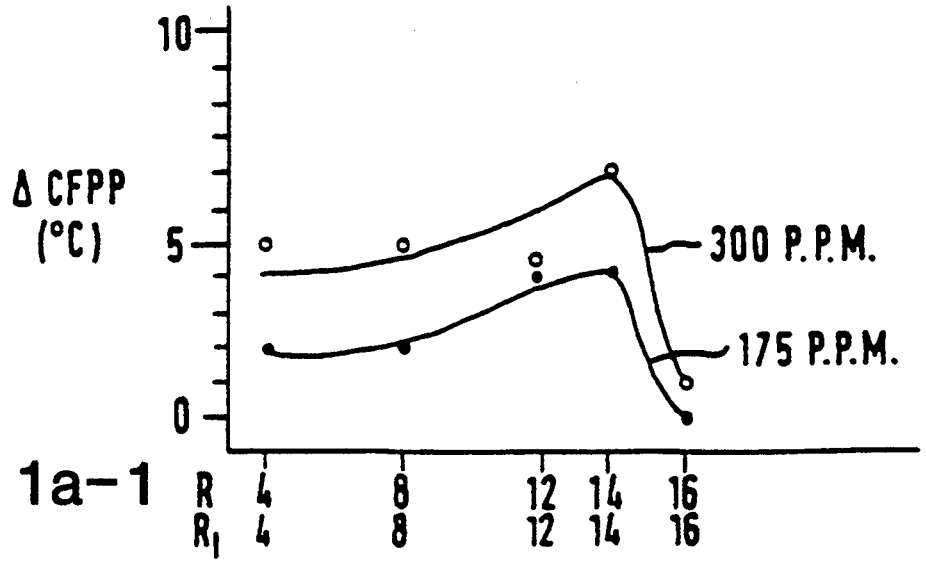

This is a continuation, of application Ser. No. 731,685, filed Jul. 17, 1991, now abandoned which is Continuation of U.S. Ser. No. 509,977, filed Apr. 16, 1990, now abandoned which is a Continuation of U.S. Ser. No. 356,544, filed May. 24, 1989, now Abandoned, which is a Continuation of U.S. Ser. No. 901,233, filed Aug. 28 1986, now Abandoned.

Mineral oils containing paraffin wax have the characteristic of becoming less fluid as the temperature of the oil decreases. This loss of fluidity is due to the crystallisation of the wax into plate-like crystals which eventually form a spongy mass entrapping the oil therein.

It has long been known that various additives act as wax crystal modifiers when blended with waxy mineral oils. These compositions modify the size and shape of wax crystals and reduce the adhesive forces between the crystals and between the wax and the oil in such a manner as to permit the oil to remain fluid at a lower temperature.

Various pour point depressants have been described in the literature and several of these are in commercial use. For example, U.S. Pat. No. 3,048,479 teaches the use of copolymers of ethylene and $C_3$–$C_5$ vinyl esters, e.g. vinyl acetate, as pour depressants for fuels, specifically heating oils, diesel and jet fuels. Hydrocarbon polymeric pour depressants based on ethylene and higher alpha-olefins, e.g. propylene, are also known. U.S. Pat. No. 3,961,916 teaches the use of a mixture of copolymers, one of which is a wax crystal nucleator and the other a growth arrestor to control the size of the wax crystals.

United Kingdom Patent 1,263,152 suggests that the size of the wax crystals may be controlled by using a copolymer having a lower degree of side chain branching.

It has also been proposed in, for example, United Kingdom Patent 1,469,016, that the copolymers of di-n-alkyl fumarates and vinyl acetate which have previously been used as pour depressants for lubricating oils may be used as co-additives with ethylene/vinyl acetate copolymers in the treatment of distillate fuels with high final boiling points to improve their low temperature flow properties. According to United Kingdom patent 1,469,016, these polymers may be $C_6$ to $C_{18}$ alkyl esters of unsaturated $C_4$ to $C_8$ dicarboxylic acids, particularly lauryl fumarate and lauryl-hexadecyl fumarate. Typically, the materials used are mixed esters with an average of about 12 carbon atoms (Polymer A). It is notable that the additives are shown not to be effective in the "conventional" fuels of lower Final Boiling Point (Fuels III and IV).

U.S. Pat. No. 3,252,771 relates to the use of polymers of $C_{16}$ to $C_{18}$ alpha-olefins obtained by polymerising olefin mixtures that predominate in normal $C_{16}$ to $C_{18}$ alpha-olefins with aluminium trichloride/alkyl halide catalysts as pour depressants in distillate fuels of the broad boiling, easy-to-treat types available in the United States in the early 1960's.

It has also been proposed to use additives based on olefin/maleic anhydride copolymers. For example, U.S. Pat. No. 2,542,542 uses copolymers of olefins such as octadecene with maleic anhydride esterified with an alcohol such as lauryl alcohol as pour depressants and United Kingdom Patent 1,468,588 uses copolymers of $C_{22}$–$C_{28}$ olefins with maleic anhydride esterified with behenyl alcohol as co-additives for distillate fuels but shows the polymer E to be somewhat ineffective in the CFPP test (Table 1). Similarly, Japanese Patent Publication 5,654,037 uses olefin/maleic anhydride copolymers which have been reacted with amines as pour point depressants and in Example 4, a copolymer from a $C_{16}/C_{18}$ olefin reacted with distearyl amine is used. Japanese Patent Publication 5,654,038 is similar, except that the derivatives of the olefin/maleic anhydride copolymers are used together with conventional middle distillate flow improvers such as ethylene vinyl acetate copolymers. This patent shows the mixtures to have activity in the CFPP test although the derivatives themselves are shown in Table 4 to be virtually inactive.

Japanese Patent Publication 5,540,640 discloses the use of olefin/maleic anhydride copolymers (not esterified) and states that the olefins used should contain more than 20 carbon atoms to obtain CFPP activity. There is comparative data showing that $C_{14}$ materials are inactive and that when the copolymers are esterified (as in Japanese Patent Publication 5,015,005) they are also inactive. Mixtures of olefins are used to produce the copolymers.

Various patents teach the use of esterified/olefine maleic anhydride copolymers in combination with other additives as distillate flow improvers showing the copolymers themselves to be largely ineffective. For example United Kingdom Patent 2,192,012 uses mixtures of olefin/maleic anhydride copolymers esterified with "Diadol" branched chain alcohols and low molecular weight polyethylene, the esterified copolymers being ineffective when used as sole 30 additives. The patent specifies that the olefin should contain 10–30 carbon atoms and the alcohol 6–28 carbon atoms with the longest chain in the alcohol containing 22–40 carbon atoms. It is notable that the polymer of Example A-24 made from a $C_{18}$ olefin and a $C_{14.5}$ 35 average alcohol was ineffective in the fuel used.

With the increasing diversity in distillate fuels, types of fuel have emerged which cannot be treated by the existing additives or which require an uneconomically high level of additive to achieve the necessary reduction in their pour point and control of wax crystal size for low temperature filterability to allow them to be used commercially.

We have now surprisingly found that copolymers of olefins and maleic anhydride and derivatives thereof having a particular structure are especially useful as distillate additives in a broad range of types of distillate fuel including the high cloud point fuels currently available in Europe and the lower cloud less waxy North American fuels, providing they have a particular structure. We find that these copolymers are useful both on their own and in combination with other additives. In particular, we have found these additives to have a combination of effects in distillate fuels not only improving the CFPP performance but lowering the cloud point of the fuel (the temperature at which the wax begins to appear) and improving low temperature filterability under slow cooling conditions.

The present invention therefore provides the use as an additive for improving the low temperature properties of distillate fuels of copolymers of straight chain alpha olefins and maleic anhydride esterified with an alcohol wherein the alpha olefin is of the formula:

$$R.CH{=}CH_2$$

and the alcohol is of the formula:

$R^1OH$ and at least one of R and $R^1$ is greater than 10 and the sum of R and $R^1$ is from 18 to 38 and $R^1$ is linear or contains a methyl branch at the 1 or 2 position.

The additives are preferably used in an amount from 0.0001 to 0.5 wt %, preferably 0.001 and 0.2 wt % based on the weight of the distillate petroleum fuel oil, and the present invention also includes such treated distillate fuel.

The present invention therefore further provides a distillate fuel boiling in the range 120° C. to 500° C. containing 0.0001 to 0.5 wt % of copolymer of a straight chain alpha olefin and maleic anhydride esterified with a alcohol wherein the alpha olefin is of the formula:

$R.CH{=}CH_2$ and the alcohol is of the formula:

$R^1OH$ and at least one of R and $R^1$ is greater than 10 and the sum of R and $R^1$ is from 18 to 38 and $R^1$ is linear or contains a methyl branch at the 1 or 2 position. The polymers or copolymers used in the present invention preferably have a number average molecular weight in the range of 1000 to 500,000, preferably 5,000 to 100,000, as measured, for example, by Gel Permeation Chromatography.

The copolymers of the alpha olefin and maleic anhydride may conveniently be prepared by polymerising the monomers solventless or in a solution of a hydrocarbon solvent such as heptane, benzene, cyclohexane, or white oil, at a temperature generally in the range of from 20° C. to 150° C. and usually promoted with a peroxide or azo type catalyst, such as benzoyl peroxide or azo-di-isobutyro-nitrile, under a blanket of an inert Gas such as nitrogen or carbon dioxide, in order to exclude oxygen. It is preferred but not essential that equimolar amounts of the olefin and maleic anhydride be used although molar proportions in the range of 2 to 1 and 1 to 2 are suitable. Examples of olefins that may be copolymerised with maleic anhydride are 1-decene, 1-dodecene, 1-tetradecene, 1-hexadecene, 1-octene.

The copolymer of the olefin and maleic anhydride may be esterified by any suitable technique and although preferred it is not essential that the maleic anhydride be at least 50% esterified. Examples of alcohols which may be used include n-decan-1-ol, n-dodecan-1-ol, n-tetradecan-1-ol, n-hexadecan-1-ol, n-octadecan-1-ol. The alcohols may also include up to one methyl branch per chain, for example, 1-methyl, pentadecan-1-ol, 2-methyltridecan-1-ol. The alcohol may be a mixture of normal and single methyl branched alcohols. Each alcohol may be used to esterify copolymers of maleic anhydride with any of the olefins. It is preferred to use pure alcohols rather than the commercially available alcohol mixtures but if mixtures are used then $R^1$ refers to the average number of carbon atoms in the alkyl group, if alcohols that contain a branch at the 1 or 2 positions are used $R^1$ refers to the straight chain backbone segment of the alcohol. When mixtures are used, it is important that no more than 15% of the $R^1$ groups have the value $>R^1+2$. The choice of the alcohol will, of course, depend upon the choice of the olefin copolymerised with maleic anhydride so that $R+R^1$ is within the range 18 to 38. The preferred value of $R+R^1$ may depend upon the boiling characteristics of the fuel in which the additive is to be used, especially preferred are compounds where $R+R'$ is from 20 to 32.

The additives of the present invention are particularly effective when used in combination with other additives known for improving the cold flow properties of distillate fuels generally, although they may be used on their own. Examples of other additives with which the additives of the present invention may be used are the polyoxyalkylene esters, ethers, ester/ethers and mixtures thereof, particularly those containing at least one, preferably at least two $C_{10}$ to $C_{30}$ linear saturated alkyl groups and a polyoxyalkylene group of molecular weight 100 to 5,000 preferably 200 to 5,000, the alkyl group in said polyoxyalkylene group containing from 1 to 4 carbon atoms. These materials form the subject of European Patent Publication 0,061,895 A2. Other such additives are described in U.S. Pat. No. 4,491, 455.

The preferred esters, ethers or ester/ethers useful in the present invention may be structurally depicted by the formula:

$R{-}O{-}(A){-}O{-}R^1$ where R and $R^1$ are the same or different and may be i) n-alkyl ii) $\text{n-alkyl-}\overset{O}{C}$ iii) $\text{n-alkyl-O}{-}\overset{O}{C}{-}(CH_2)_n{-}$ iv) $\text{n-alkyl-O}{-}\overset{O}{C}(CH_2)_n{-}\overset{O}{C}{-}$ the alkyl group being linear and saturated and containing 10 to 30 carbon atoms, and A represents the polyoxyalkylene segment in which the alkylene group has 1 to 4 carbon atoms, such as polyoxymethylene, polyoxyethylene or polyoxytrimethylene moiety which is substantially linear; some degree of branching with lower alkyl side chains (such as in polyoxypropylene glycol) may be tolerated but it is preferred the glycol should be substantially linear. Compounds of similar structure which contain nitrogen and 2 or 3 esterified polyoxalkylene groups of the type described.

Suitable glycols generally are the substantially linear polyethylene glycols (PEG) and polypropylene glycols (PPG) having a molecular weight of about 100 to 5,000, preferably about 200 to 2,000. Esters are preferred and fatty acids containing from 10–30 carbon atoms are useful for reacting with the glycols to form the ester additives and it is preferred to use a $C_{18}$–$C_{24}$ fatty acid, especially behenic acids. The esters may also be prepared by esterifying polyethoxylated fatty acids or polyethoxylated alcohols.

Polyoxyalkylene diesters, diethers, ether/esters and mixtures thereof are suitable as additives with diesters preferred for use in narrow boiling distillates whilst minor amounts of monoethers and monoesters may also be present and are often formed in the manufacturing process. It is important for additive performance that a major amount of the dialkyl compound is present. In particular, stearic or behenic diesters of polyethylene glycol, polypropylene glycol or polyethylene/polypropylene glycol mixtures are preferred.

The additives of this invention may also be used with ethylene unsaturated ester copolymer flow improvers. The unsaturated monomers which may be copolymerised with ethylene include unsaturated mono and diesters of the general formula:

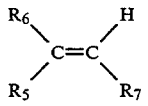

wherein $R_6$ is hydrogen or methyl, $R_5$ is a —$OOCR_8$ group wherein $R_8$ is hydrogen or a $C_1$ to $C_{28}$, more usually $C_1$ to $C_{17}$, and preferably a $C_1$ to $C_8$, straight or branched chain alkyl group; or $R_5$ is a —$COOR_8$ group wherein $R_8$ is as previously described but is not hydrogen and $R_7$ is hydrogen or —$COOR_8$ as previously defined. The monomer, when $R_5$ and $R_7$ are hydrogen and $R_6$ is —$OOCR_8$, includes vinyl alcohol esters of $C_1$ to $C_{29}$, more usually $C_1$ to $C_{18}$, monocarboxylic acid, and preferably $C_2$ to $C_{29}$, more usually $C_1$ to $C_{18}$, monocarboxylic acid, and preferably $C_2$ to $C_5$ monocarboxylic acid. Examples of vinyl esters which may be copolymerised with ethylene include vinyl acetate, vinyl propionate and vinyl butyrate or isobutyrate, vinyl acetate being preferred. We prefer that the copolymers contain from 20 to 40 wt % of the vinyl ester, more preferably from 25 to 35 wt % vinyl ester. They may also be mixtures of two copolymers such as those described in U.S. Pat. No. 3,961,916. It is preferred that these copolymers have a number average molecular weight as measured by vapour phase osmometry of 1,000 to 6,000, preferably 1,000 to 3,000.

Some examples of ethylene-vinyl acetate copolymers are:

| | Vinyl Acetate Content (wt %) (by 500 MHz NMR | Number Average Molecular Wt. Mn. (by Vapour Phase Osmometry) | Degree of Side Chain Branching Methyls/100 methylenes (by 500 MHz NMR) |
|---|---|---|---|
| I | 36 | 2,000 | 4 |
| II | 17 | 3,500 | 8 |
| III | a 3/1 mixture of I/II respectively | | |

The additives of the present invention may also be used in distillate fuels in combination with polar compounds, either ionic or non-ionic, which have the capability in fuels of acting as wax crystal growth inhibitors. Polar nitrogen containing compounds have been found to be especially effective when used in combination with the glycol esters, ethers or ester/ethers and such three component mixtures are within the scope of the present invention. These polar compounds are generally amine salts and/or amides formed by reaction of at least one molar proportion of hydrocarbyl substituted amines with a molar proportion of hydrocarbyl acid having 1 to 4 carboxylic acid groups or their anhydrides; ester/amides may also be used containing 30 to 300, preferably 50 to 150 total carbon atoms. These nitrogen compounds are described in U.S. Pat. No. 4,211,534. Suitable amines are usually long chain $C_{12}$–$C_{40}$ primary, secondary, tertiary or quaternary amines or mixtures thereof but shorter chain amines may be used provided the resulting nitrogen compound is oil soluble and therefore normally containing about 30 to 300 total carbon atoms. The nitrogen compound preferably contains at least one straight chain $C_8$–$C_{40}$, preferably $C_{14}$ to $C_{24}$ alkyl segment.

Suitable amines include primary, secondary, tertiary or quaternary, but preferably are secondary. Tertiary and quaternary amines can only form amine salts. Examples of amines include tetradecyl amine, cocoamine, hydrogenated tallow amine and the like. Examples of secondary amines include dioctacedyl amine, methylbehenyl amine and the like. Amine mixtures are also suitable and many amines derived from natural materials are mixtures. The preferred amine is a secondary hydrogenated tallow amine of the formula $HNR_1R_2$ wherein $R_1$ and $R_2$ are alkyl groups derived from hydrogenated tallow fat composed of approximately 4% $C_{14}$, 31% $C_{16}$, 59% $C_{18}$.

Examples of suitable carboxylic acids for preparing these nitrogen compounds (and their anhydrides) include cyclo-hexane, 1,2 dicarboxylic acid, cyclohexane dicarboxylic acid, cyclopentane 1,2 dicarboxylic acid, naphthalene dicarboxylic acid and the like. Generally, these acids will have about 5–13 carbon atoms in the cyclic moiety. Preferred acids useful in the present invention are benzene dicarboxylic acids such as phthalic acid, isophthalic acid, and terephthalic acid. Phthalic acid or its anhydride is particularly preferred. The particularly preferred compound is the amide-amine salt formed by reacting 1 molar portion of phthalic anhydride with 2 molar portions of dihydrogenated tallow amine. Another preferred compound is the diamide formed by dehydrating this amide-amine salt.

The relative proportions of additives used in the mixtures are from 0.05 to 20 parts by weight of the polymer of the invention to 1 part of the other additive or additives more preferably from 0.1 to 5 parts by weight of the polymer of the invention.

The additive systems of the present invention may conveniently be supplied as concentrates for incorporation into the bulk distillate fuel. These concentrates may also contain other additives as required. These concentrates preferably contain from 3 to 75 wt %, more preferably 3 to 60 wt %, most preferably 10 to 50 wt % of the additives, preferably in solution in oil. Such concentrates are also within the scope of the present invention.

The additives of this invention may be used in the broad range of distillate fuels boiling in the range 120° to 500° C. The optimum value of $R+R^1$ may depend upon the wax content and possibly the boiling points of the fuel. Generally, we prefer that the higher the final boiling point of the fuel, the higher the value of R and $R^1$. We have also found that when the copolymers of the present invention are used as sole additives, $R+R^1$ is preferably no more than 34, whereas when the copolymers are used as coadditives with the other additives described herein, $R+R^1$ may be up to 38.

The present invention is illustrated by the following examples in which the effectiveness of the additives of the present invention as cloud point depressants and filterability improvers were compared with other similar copolymers in the following tests.

By one method, the response of the oil to the additives was measured by the Cold Filter Plugging Point Test (CFPP) which is carried out by the procedure described in detail in "Journal of the Institute of Petroleum", volume 52, Number 510, June 1966, pp. 173–185. This test is designed to correlate with the cold flow of a middle distillate in automotive diesels.

In brief, a 40 ml. sample of the oil to be tested is cooled in a bath which is maintained at about −34° C. to give non-linear cooling at about 1° C./min. Periodically (at each one degree Centigrade drop in temperature starting from at least 2° C. above the cloud point), the cooled oil is tested for its ability to flow through a fine screen in a prescribed time period using a test device which is a pipette to whose lower end is attached an inverted funnel which is positioned below the surface of the oil to be tested. Stretched across the mouth of the funnel is a 350 mesh screen having an area defined by a 12 millimeter diameter. The periodic tests are each initiated by applying a vacuum to the upper end of the pipette whereby oil is drawn through the screen up into the pipette to a mark indicating 20 ml. of oil. After each successful passage, the oil is returned immediately to the CFPP tube. The test is repeated with each one degree drop in temperature until the oil fails to fill the pipette within 60 seconds. This temperature is reported as the CFPP temperature. The difference between the CFPP of an additive free fuel and of the same fuel containing additive is reported as the CFPP depression by the additive. A more effective flow improver gives a greater CFPP depression at the same concentration of additive.

Another determination of flow improver effectiveness is made under conditions of the flow improver Programmed Cooling Test (PCT) which is a slow cooling test designed to correlate with the pumping of a stored heating oil. In the test, the cold flow properties of the described fuels containing the additives were determined as follows. 300 ml. of fuel are cooled linearly at 1° C./hour to the test temperature and the temperature then held constant. After 2 hours at −9° C., approximately 20 ml. of the surface layer is removed as the abnormally large wax crystals which tend to form on the oil/air interface during cooling. Wax which has settled in the bottle is dispersed by gentle stirring, then a CFPP filter assembly is inserted. The tap is opened to apply a vacuum of 500 min. of mercury and closed when 200 ml. of fuel have passed through the filter into the graduated receiver. A PASS is recorded if the 200 ml. are collected within ten seconds through a given mesh size or a FAIL if the flow rate is too slow indicating that the filter has become blocked.

CFPP filter assemblies with filter screens of 20, 30, 40, 60, 80, 100, 120, 150, 200, 250 and 350 mesh number are used to determine the finest mesh (largest mesh number) the fuel will pass. The larger the mesh number that a wax containing fuel will pass, the smaller are the wax crystals and the greater the effectiveness of the additive flow improver. It should be noted that no two fuels will give exactly the same test results at the same treatment level for the same flow improver additive.

A range of copolymers of alpha olefins and maleic anhydride were prepared by copolymerising 1.05 moles of the alpha olefin with 1.0 moles of maleic anhydride in benzene solvent under reflux using 0.02 moles of catalyst per mole of maleic anhydride. The catalysts used were benzoyl peroxide, t-butyl peroctoate, and azobisisobutyronitrile and were added continuously through the reaction, e.g. say over 4 hours. After a soak period, the polymerisation is terminated.

Esterification of the polymers was carried out by reacting 1.0 moles of the copolymer with 2.05 moles of alcohol in the presence of about 0.1 moles of p-toluene sulphonic acid or methane sulphonic acid with azeotropic removal of water.

The effectiveness of the additives of the present invention in lowering the cloud point of distillate fuels was determined by the standard Cloud Point Test (IP-219 or ASTM-D 2500) other measures of the onset of crystallisation are the Wax Appearance Point (WAP) Test (ASTM D.3117-72) and the Wax Appearance Temperature (WAT) as measured by different scanning calorimetry using a Mettier TA 2000B differential scanning calorimeter. In the test a 25 microliter sample of the fuel is cooled at 2° C./min. from a temperature at least 30° C. above the expected cloud point of the fuel. The observed onset of crystallisation is estimated, without correction for thermal lag (approximately 2° C.),as the wax appearance temperature as indicated by the differential scanning calorimeter.

The depression of the wax appearance temperature WAT is shown by comparing the result of the treated fuel ($WAT_1$) with that of the untreated fuel ($WAT_0$) as $WAT=WAT_0-WAT_1$. Depression of the WAT is indicated by a positive result.

The maximum wax precipitation rate ($MPR_1$) was also measured using the differential calorimeter, by measuring the maximum peak height above the baseline after crystallisation. This is then subtracted from the $MPR_o$ measured from the untreated fuel to give $MPR=MPR_o-MPR_1$. Arbitrary units are given here and a positive value indicates a decrease in the maximum wax precipitation rate (an advantageous result) and a negative value indicates an increase (disadvantageous).

The effect of the copolymers was tested in the following fuels as cloud point depressants, as additives to lower the CFPP temperature of the fuel and as additives in the PCT. When a co-additive is used it is the ethylene/vinyl acetate copolymer III previously described Fuels A B and C are high cloud point European fuels, whereas fuels D to G are narrower boiling lower cloud point fuels from North America.

| | FUEL CHARACTERISTICS | | | | | | | |
|---|---|---|---|---|---|---|---|---|
| | | | D86 Distillation °C. | | | | | |
| Fuel | Cloud Point °C. | Wax Appearance Point (WAP) °C. | IBP* | 20% | 50% | 90% | FBP** | Wax Appearance Temperature (WAT) °C. |
| A | 3 | 1 | 184 | 226 | 272 | 368 | 398 | −1 |
| B | 3 | 1 | 188 | 236 | 278 | 348 | 376 | −2 |
| C | 6 | 2 | 173 | 222 | 279 | 356 | 371 | 0.3 |
| D | −12 | −15 | 159 | 210 | 250 | 316 | 350 | |

-continued

FUEL CHARACTERISTICS

| Fuel | Cloud Point °C. | Wax Appearance Point (WAP) °C. | D86 Distillation °C. IBP* | 20% | 50% | 90% | FBP** | Wax Appearance Temperature (WAT) °C. |
|---|---|---|---|---|---|---|---|---|
| E | −11 | −14 | 175 | 224 | 260 | 314 | 348 | |
| F | −10 | −12 | 164 | 240 | 276 | 330 | 356 | |
| G | −9 | −12 | 168 | 231 | 271 | 325 | 350 | |

*Initial Boiling Point
**Final Boiling Point

Table 1 shows the CFPP and PCT results obtained in Fuel A for the various combinations of alcohol and olefin in the final polymers. Similarly, Table 2 shows the results for Fuel B at a treat rate of 625 ppm.

Table 3 shows the effect of depression of cloud point in Fuel A as measured by DSC Wax Appearance Temperature, (ΔWAT), and Maximum wax Precipitation Rate, (ΔMPR).

Similarly, results in Fuels B and C are depicted in Table 4 and 5.

It can be seen that in these fuels, the depression in WAT is optimal when the chains average $C_{16}$ ($R+R^1=32$).

Table 6 shows the effect of depression of cloud point of North American fuels as measured by Wax Appearance Points, (WAP), (ASTM-D 3117-72).

The results in these Tables are also shown graphically in the attached Figures in which FIGS. 1(*a*) and (*c*) show the data of Table 1 using the esterified olefin/maleic anhydride copolymer as sole additive.

Figures 1, 1A, 2:
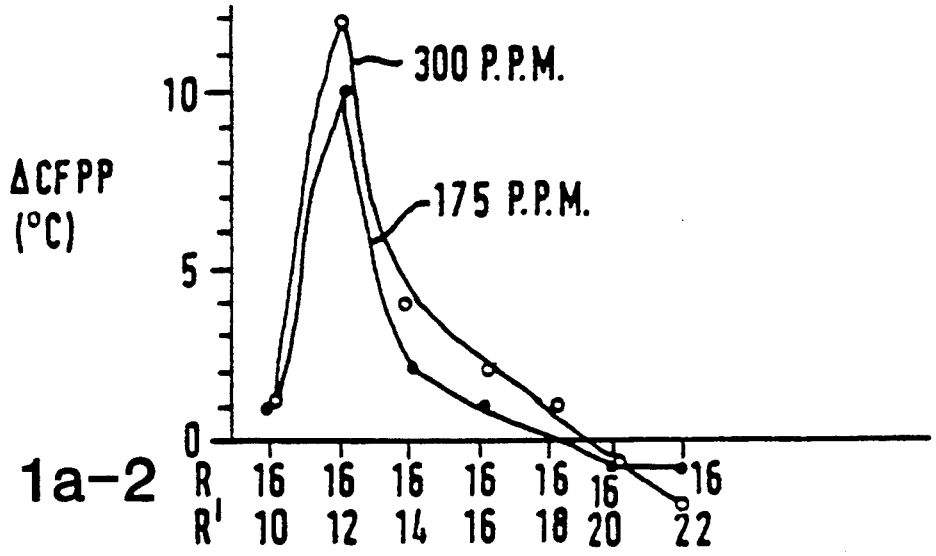

FIGS. 1(*b*) and (*d*) show the data of Table 1 using the esterified olefin/maleic anhydride copolymer together with EVA III. FIGS. 2(*a*) and (*c*) show the data of Table 2 using the esterified olefin maleic anhydride copolymer as sole additive FIGS. 2(*b*) and (*d*) show the data of Table 2 using the esterified olefin/maleic anhydride copolymer together with EVA III.

Figures 1, 1A, 2, 3:
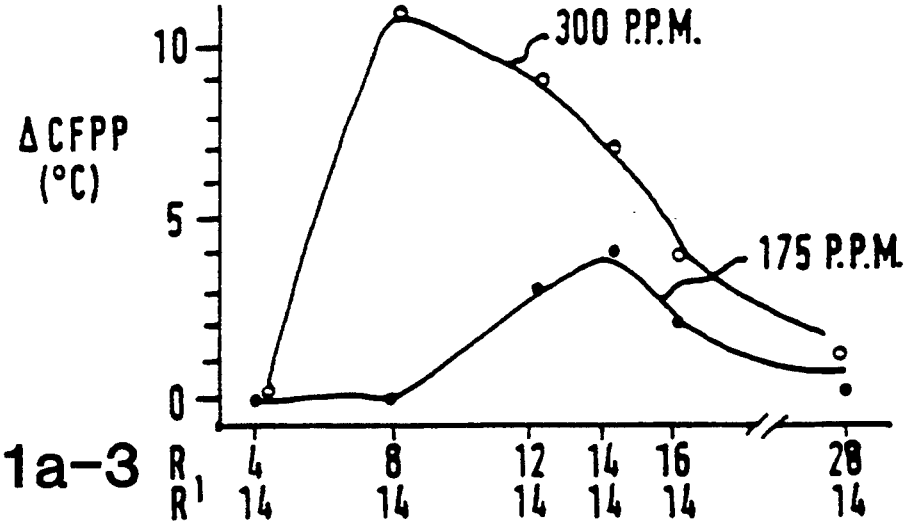
Figures 1, 1B:
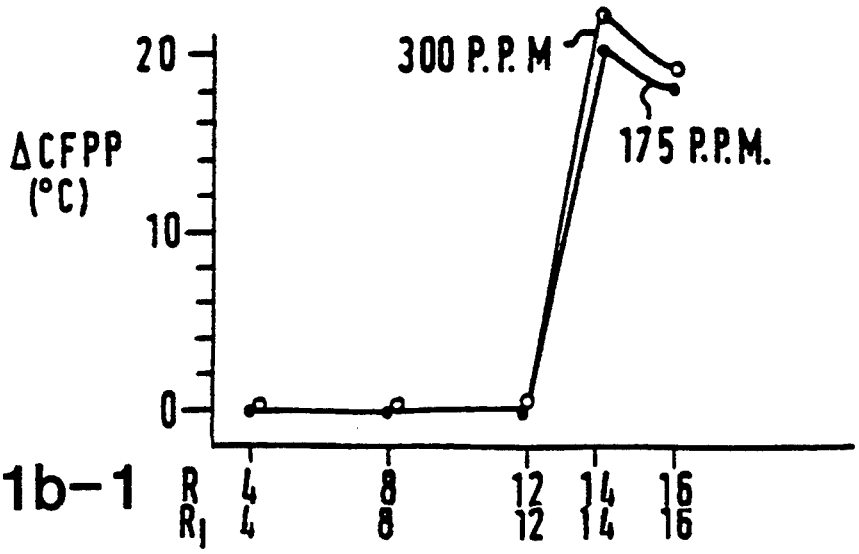
Figures 1, 1B, 2:
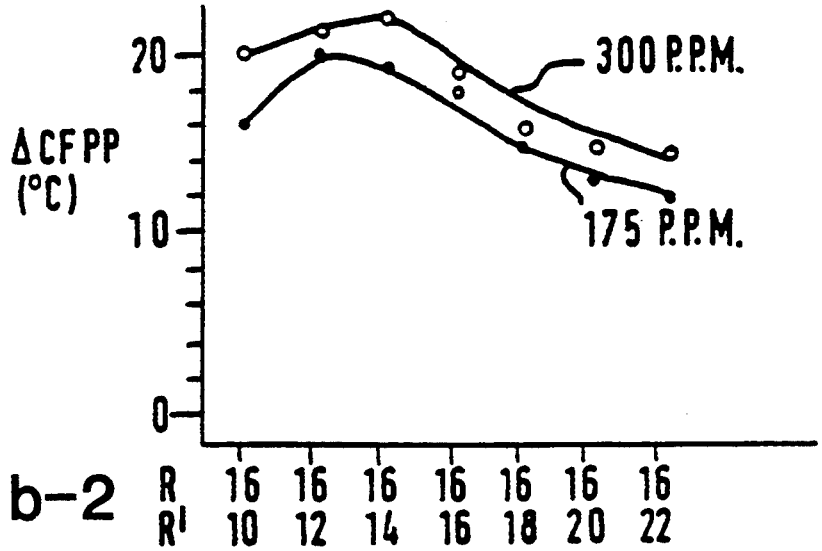
Figures 1, 1B, 2, 3:
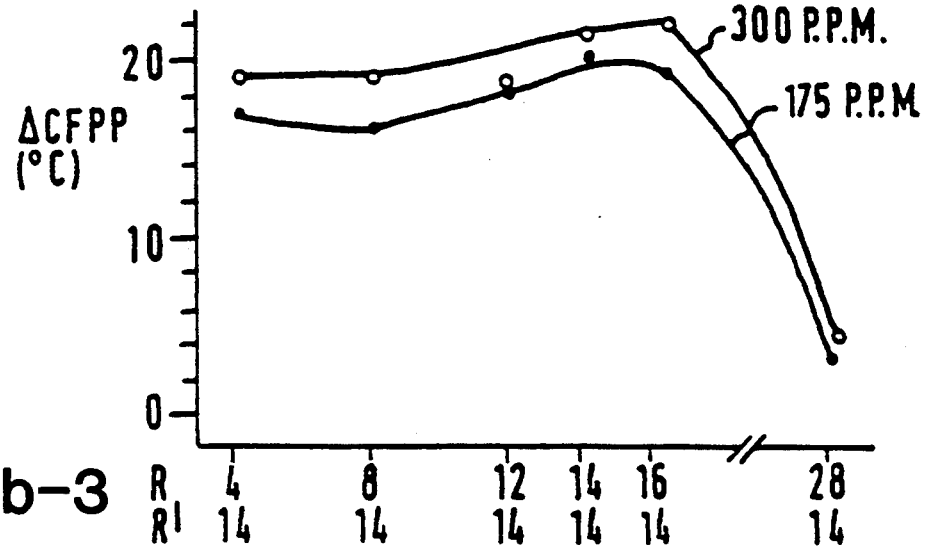
Figures 1, 1C:
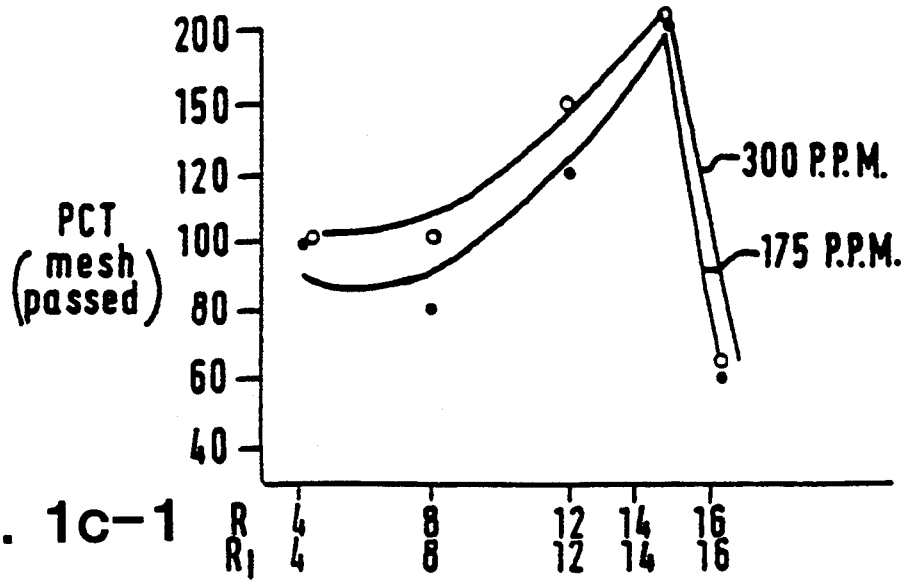
Figures 1, 1C, 2:
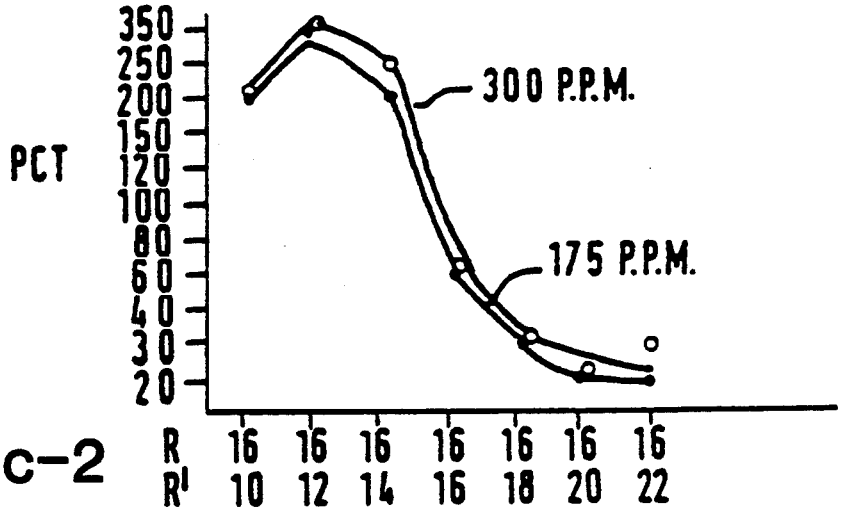
Figures 1, 1C, 2, 3:
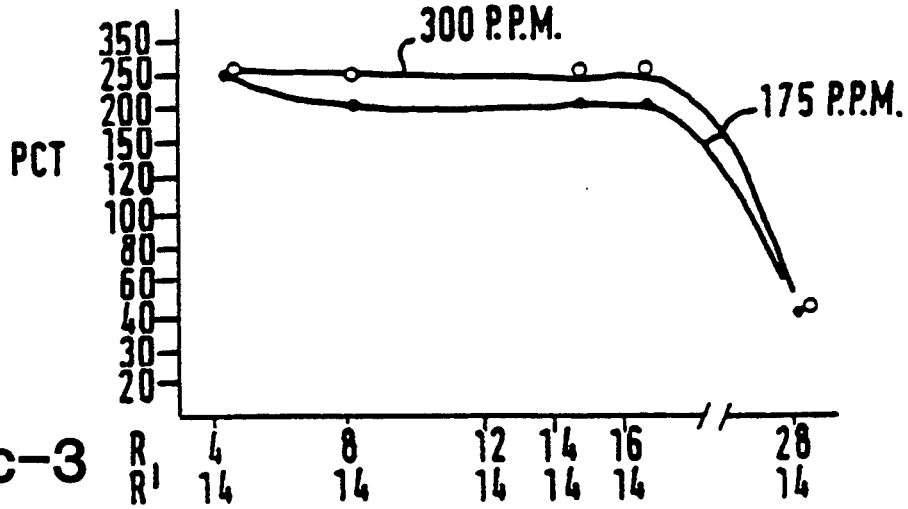
Figures 1, 1D:
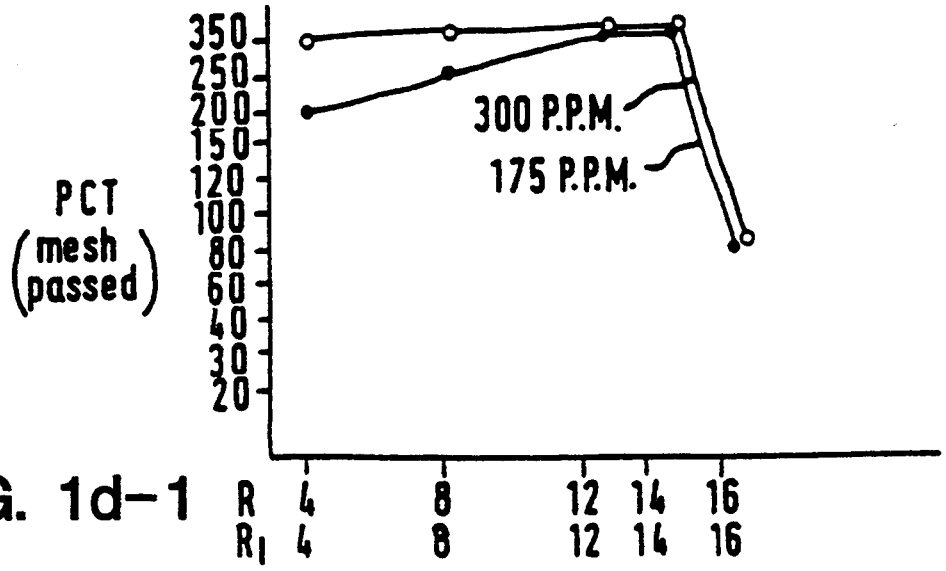
Figures 1, 1D, 2:
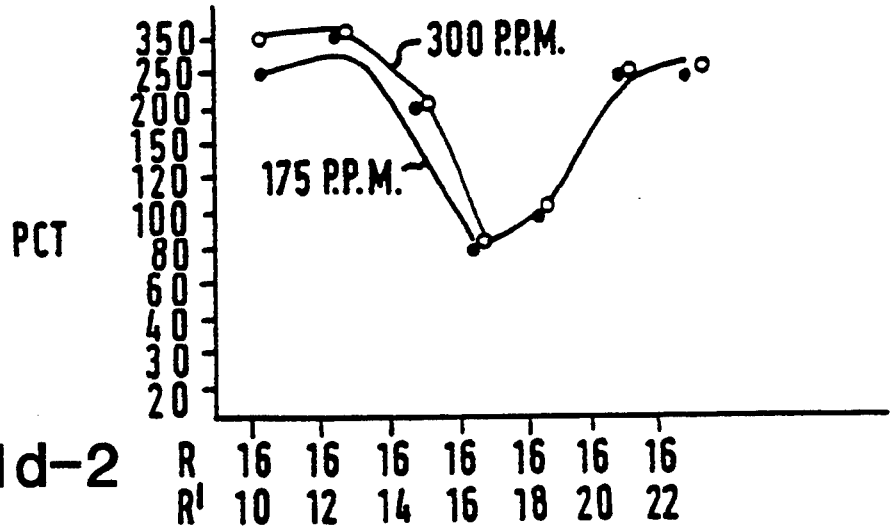
Figures 1, 1D, 2, 3:
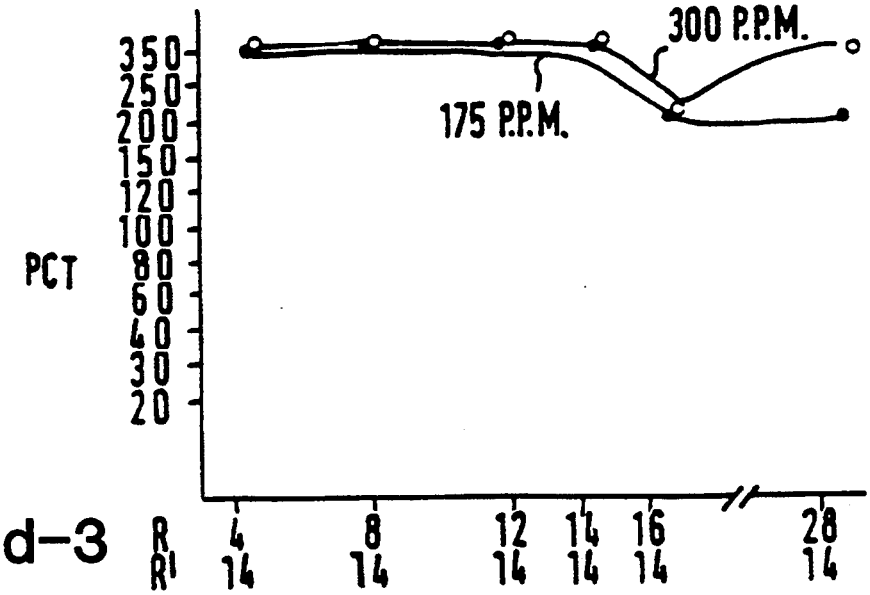
Figures 1, 2A:
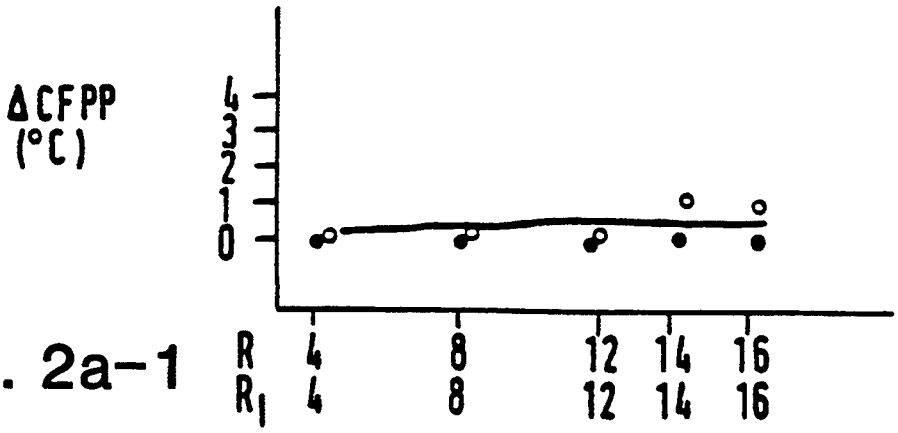
Figures 2, 2A:
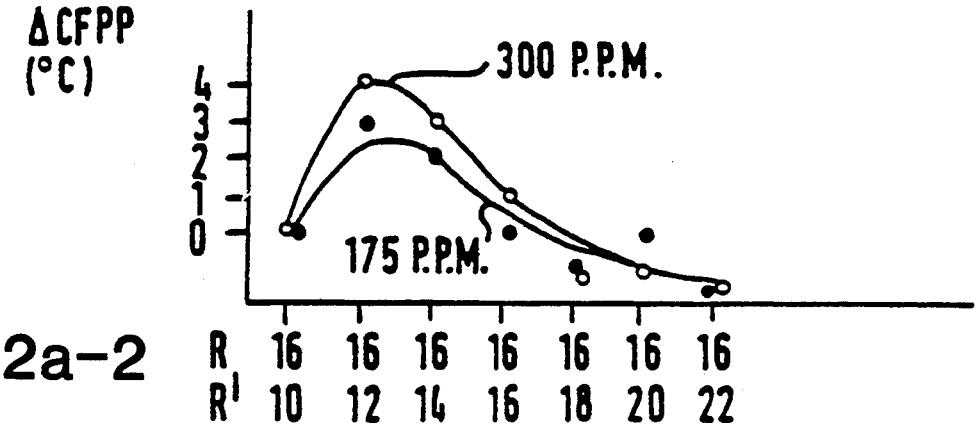
Figures 2, 2A, 3:
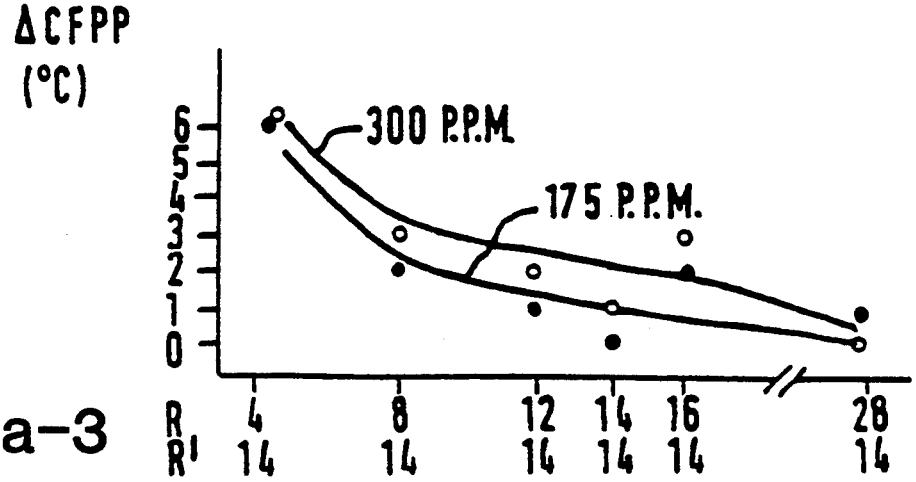
Figures 1, 2B:
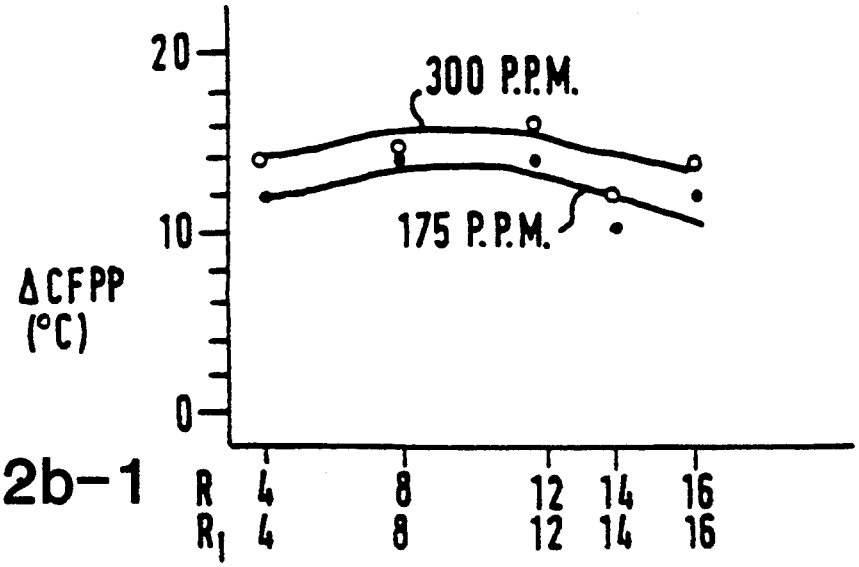
Figures 2, 2B:
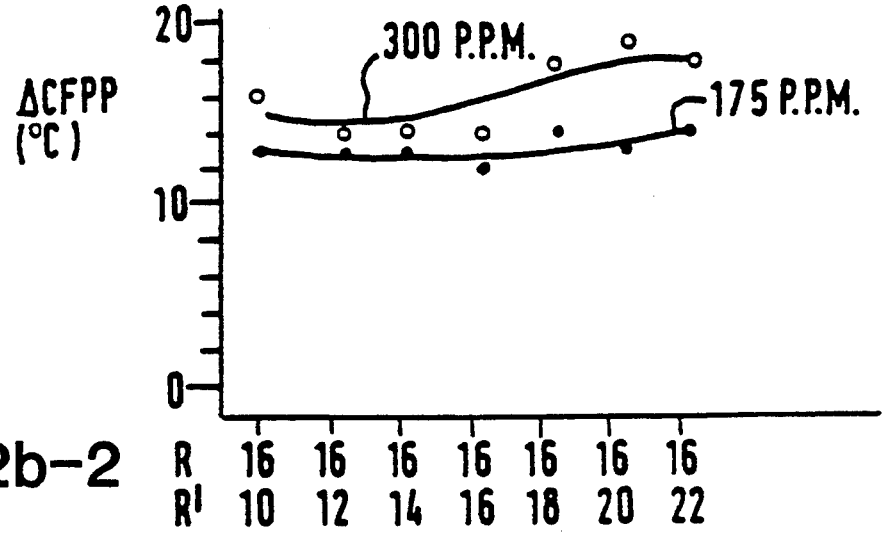
Figures 2, 2B, 3:
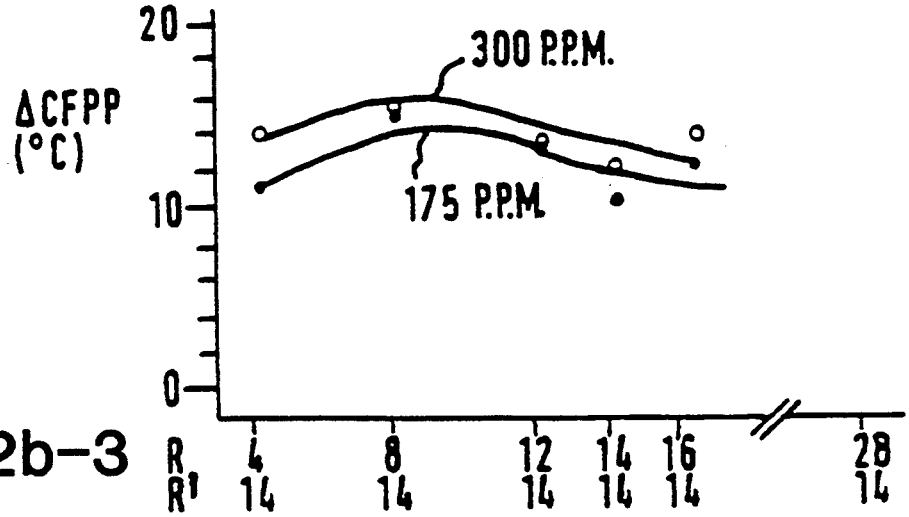
Figures 1, 2C:
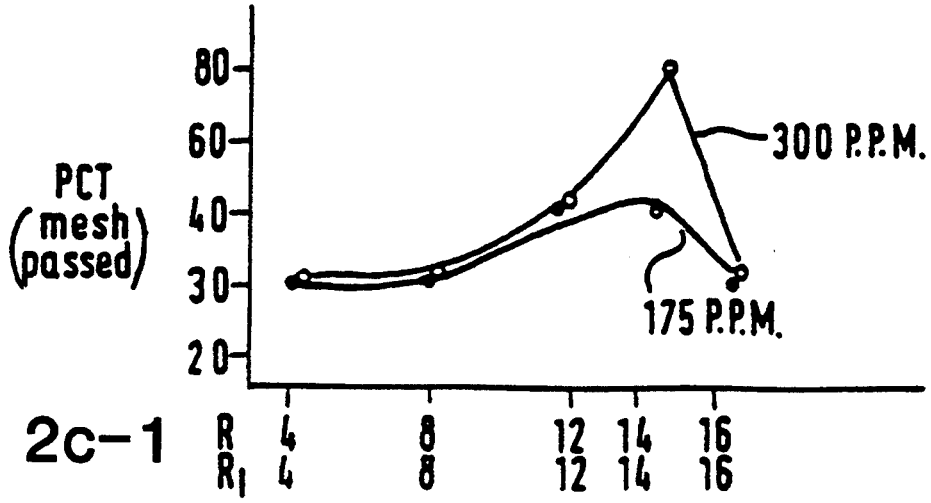
Figures 2, 2C:
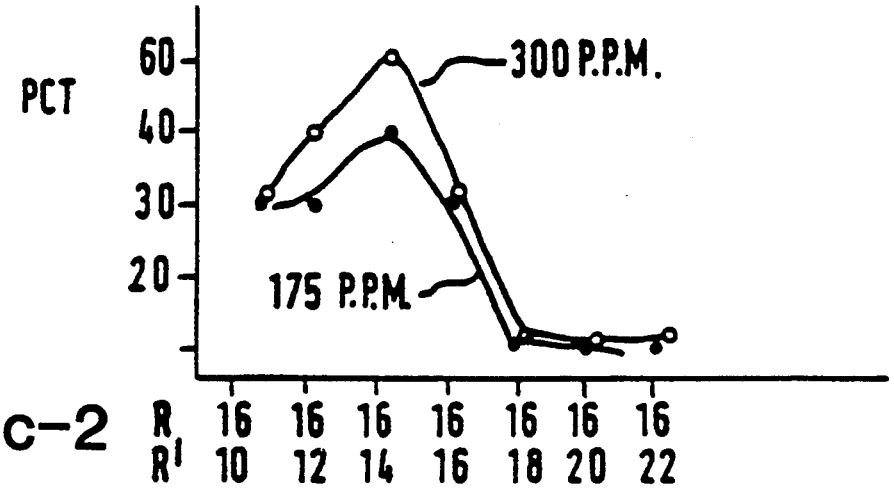
Figures 2, 2C, 3:
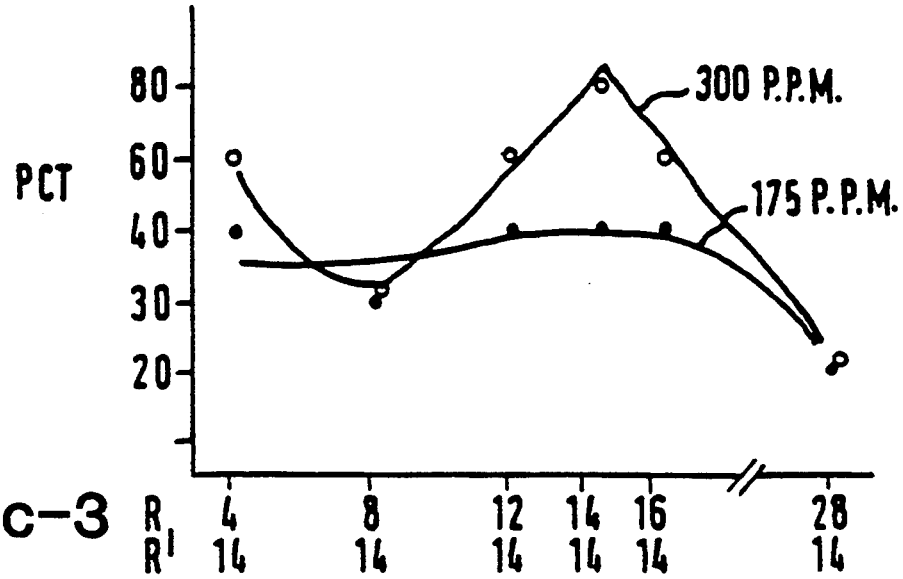
Figures 1, 2D:
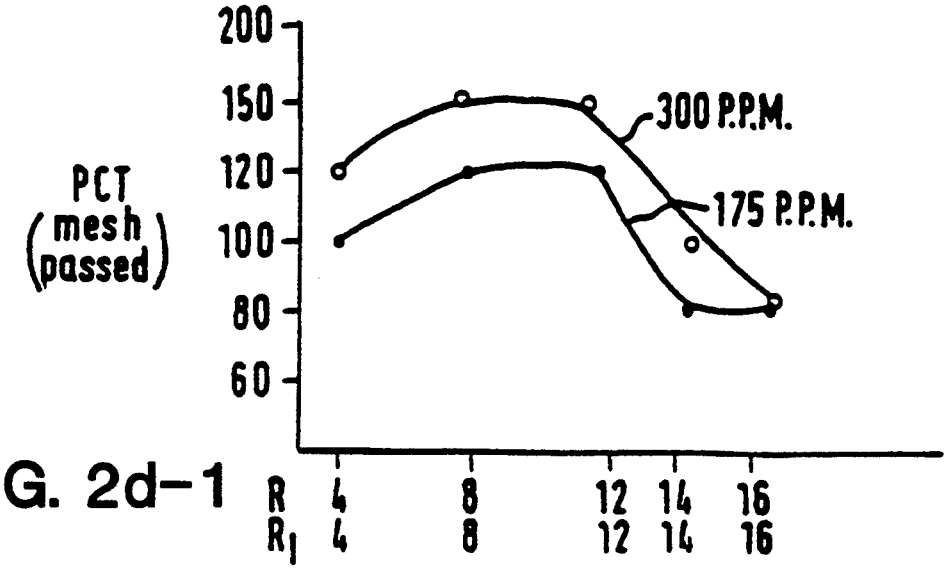
Figures 2, 2D:
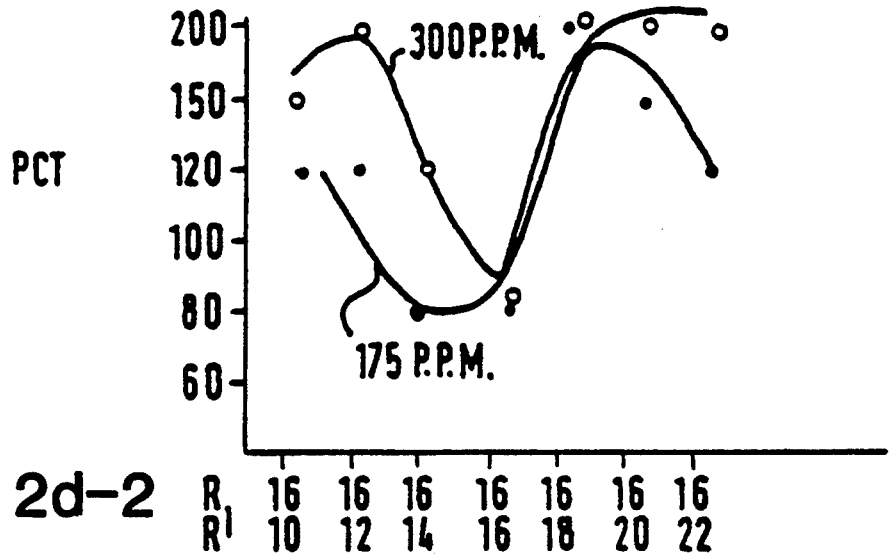
Figures 2, 2D, 3:
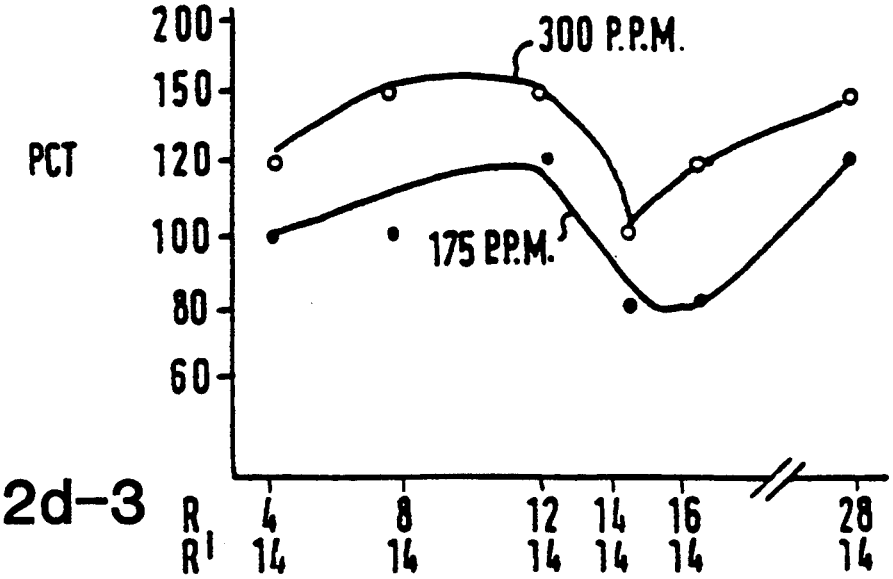
Figures 1, 3A:
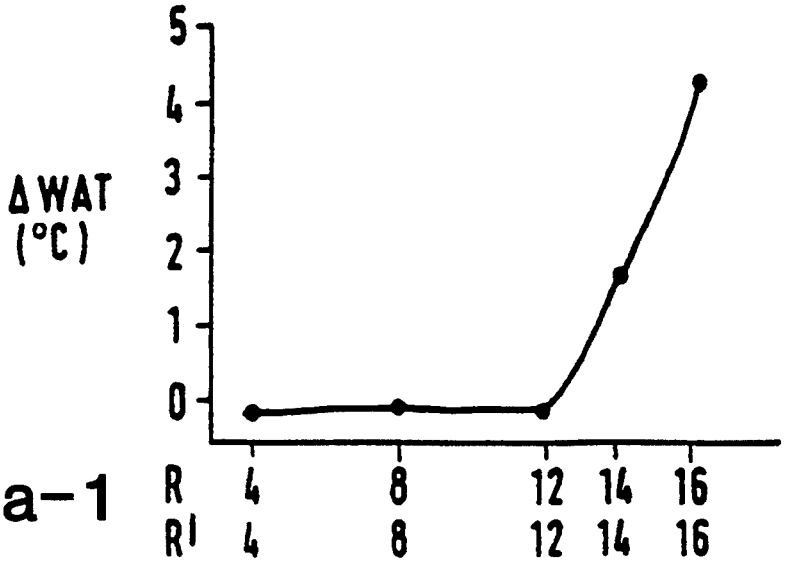
Figures 2, 3A:
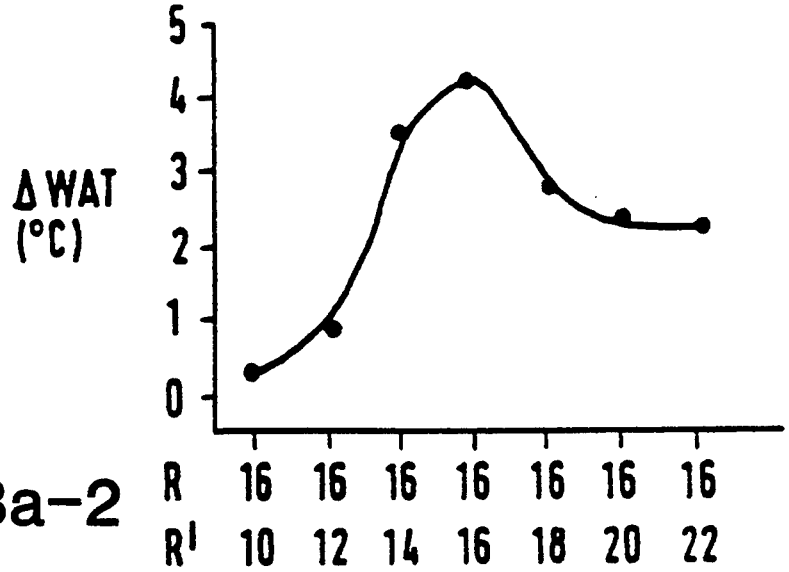
Figures 3, 3A:
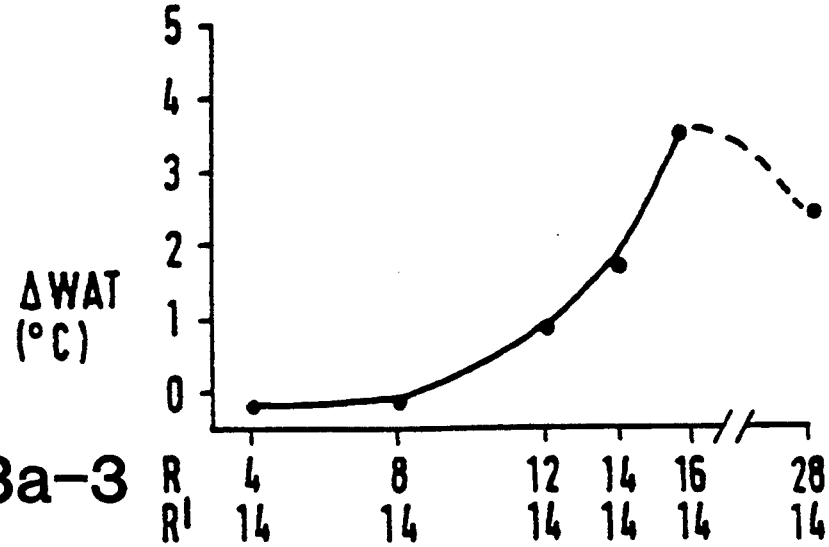
Figures 1, 3B:
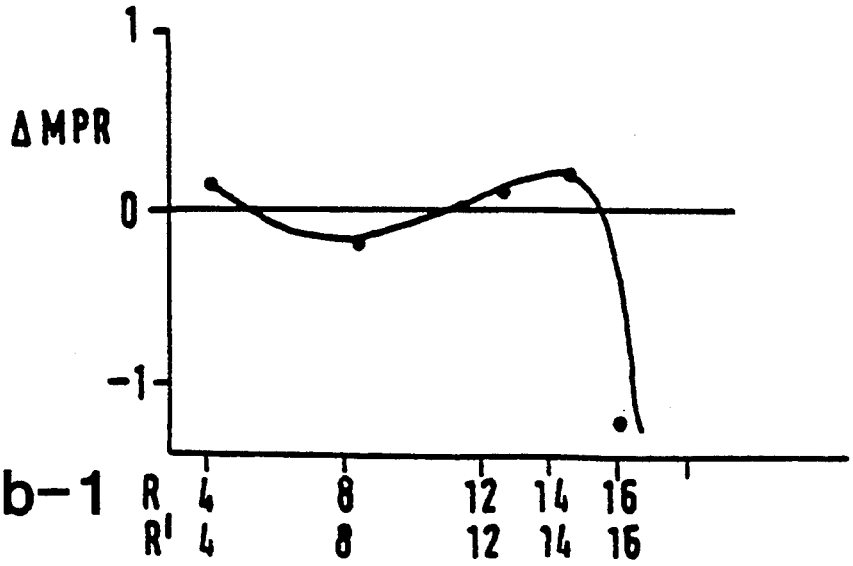
Figures 2, 3B:
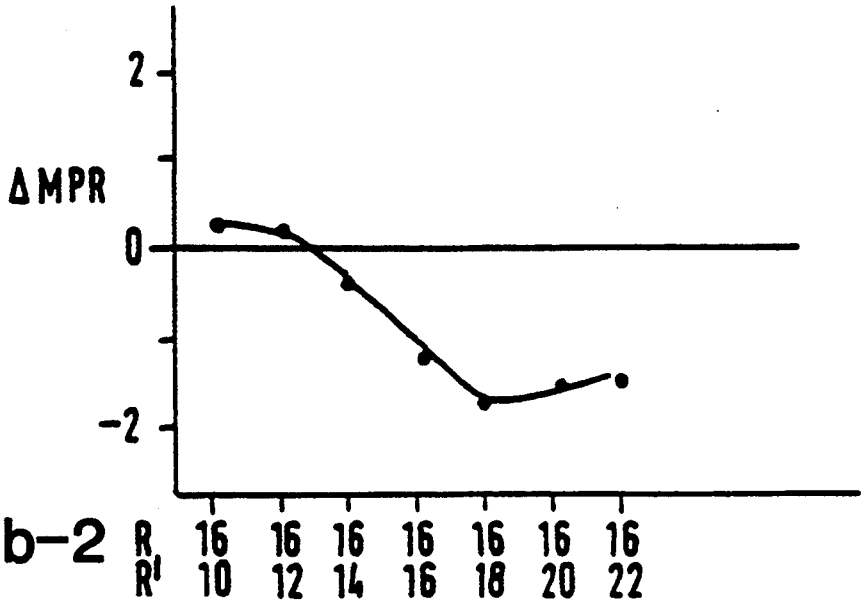
Figures 3, 3B:
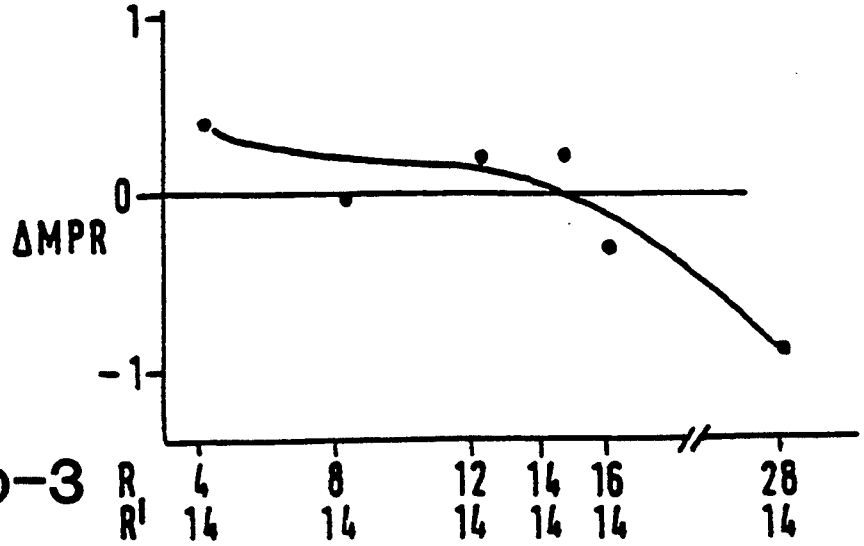
Figures 1, 4A:
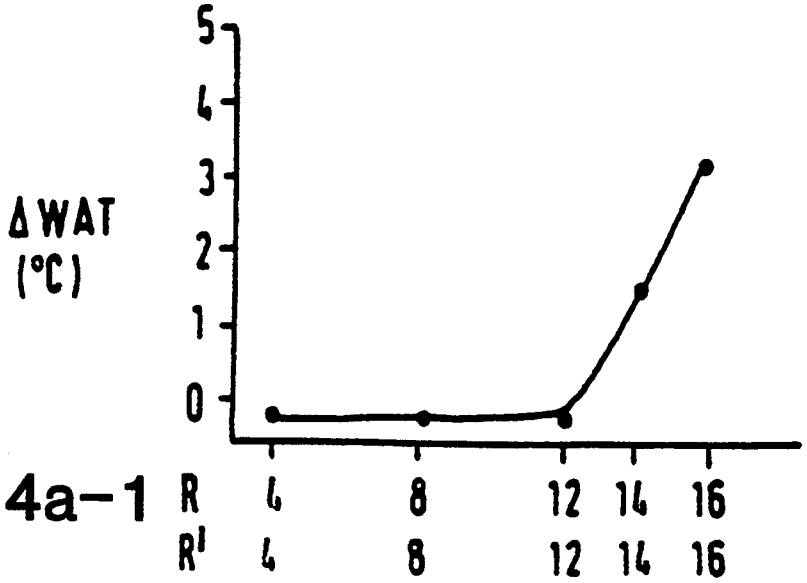
Figures 2, 4A:
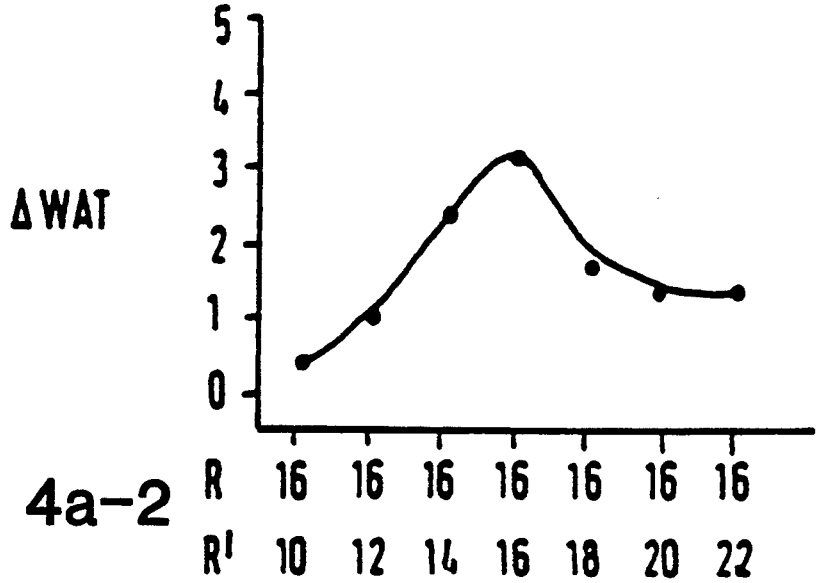
Figures 3, 4A:
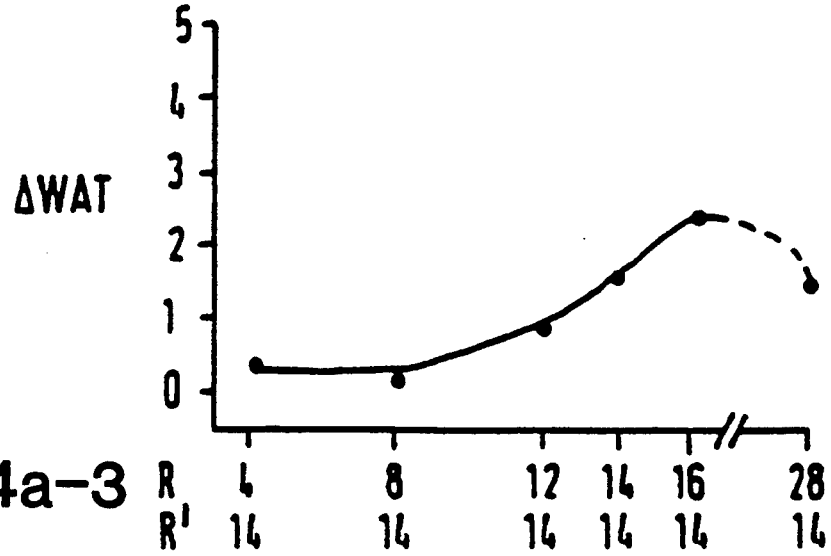
Figures 1, 4B:
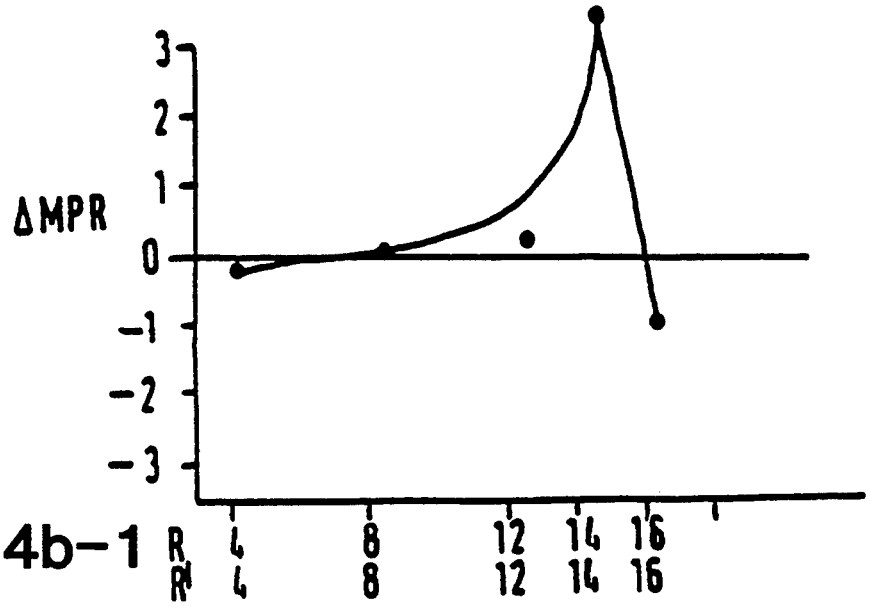
Figures 2, 4B:
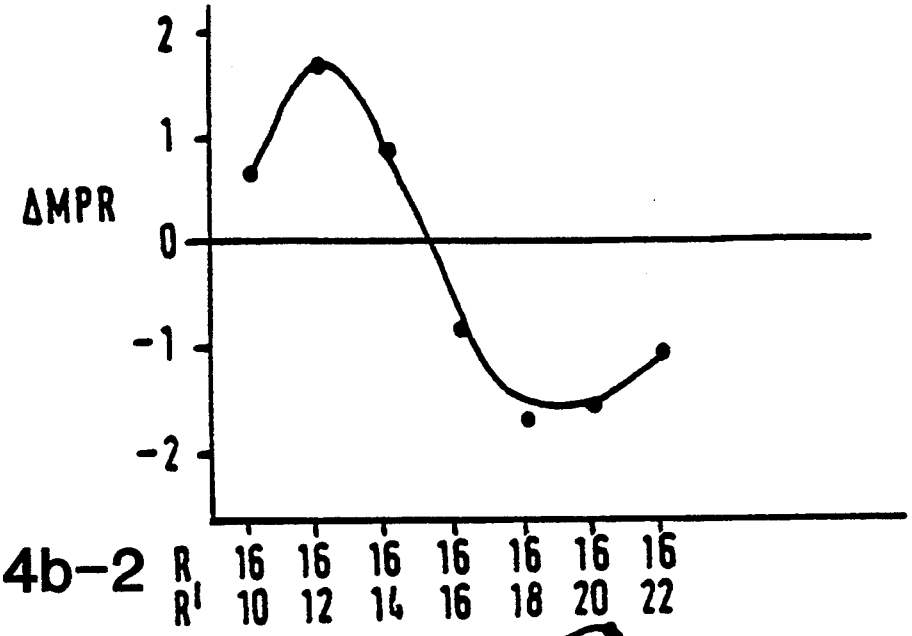
Figures 3, 4B:
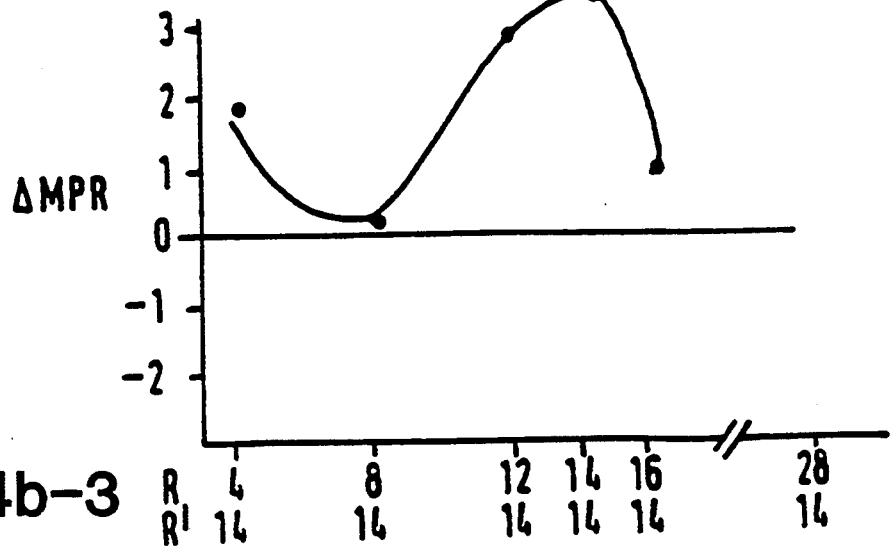
Figures 1, 5A:
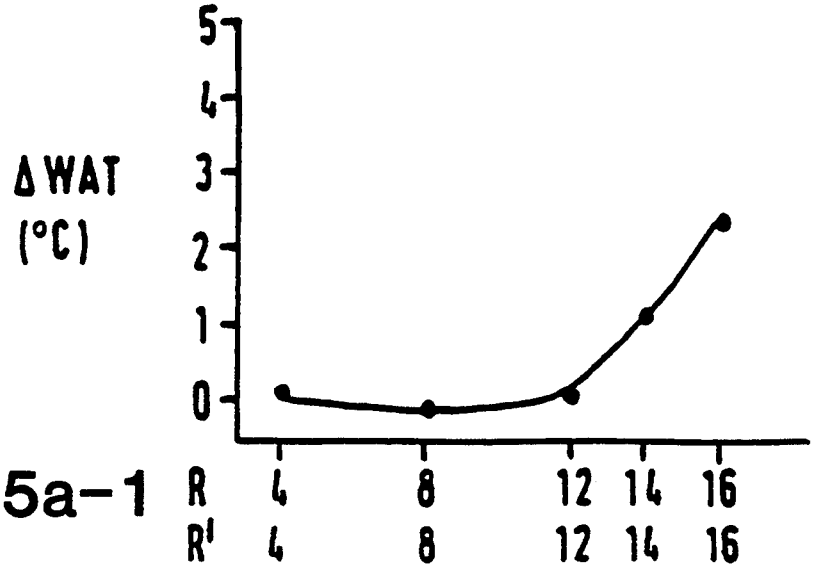
Figures 2, 5A:
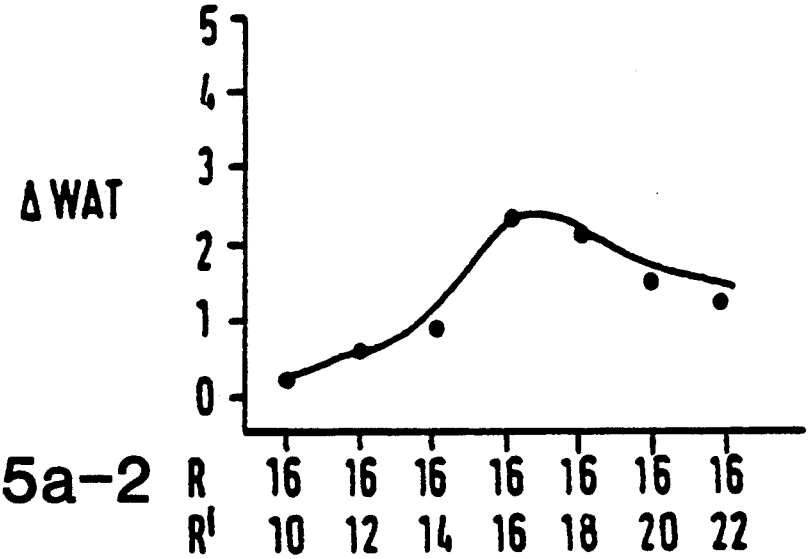
Figures 3, 5A:
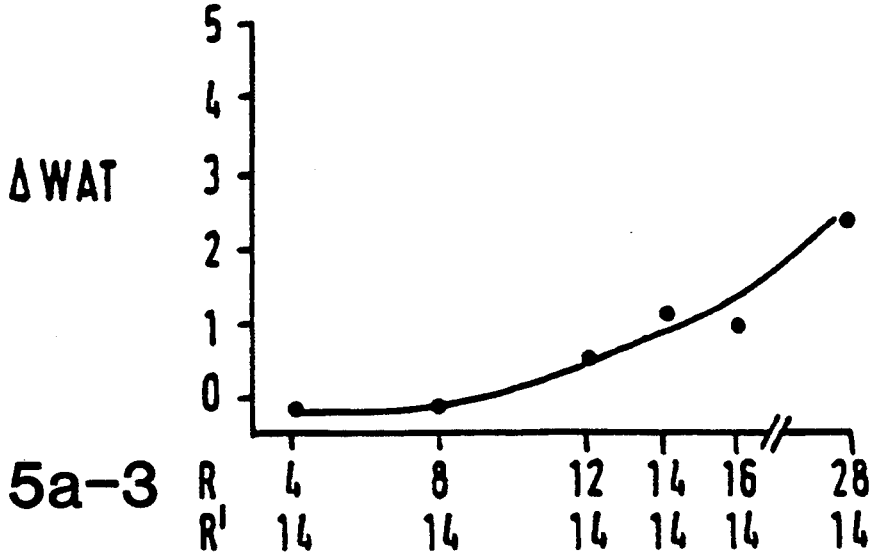
Figures 1, 5B:
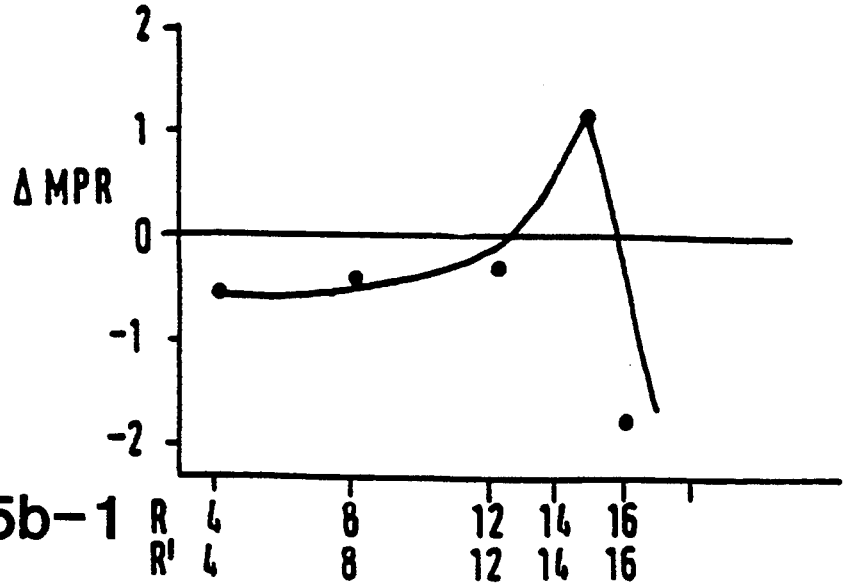
Figures 2, 5B:
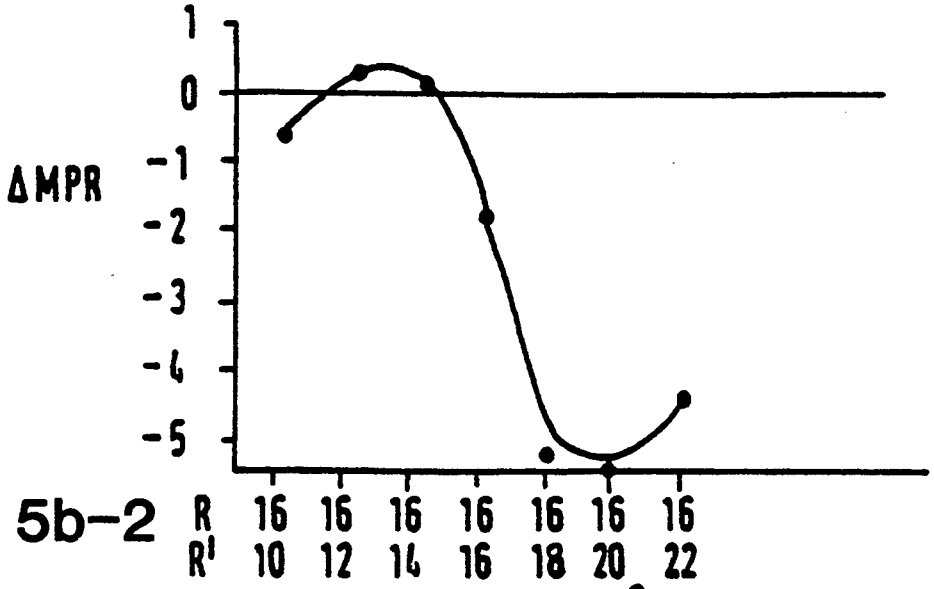
Figures 3, 5B:
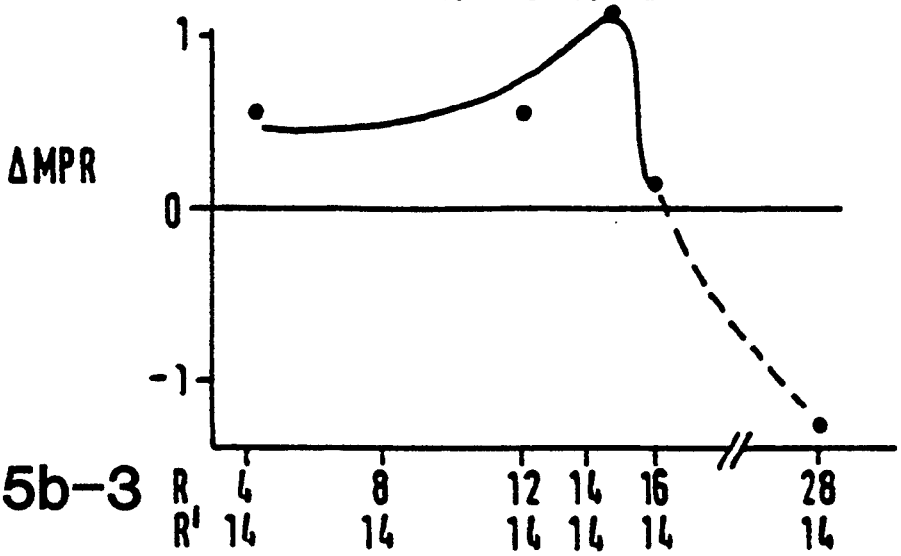
Figures 1, 6A:
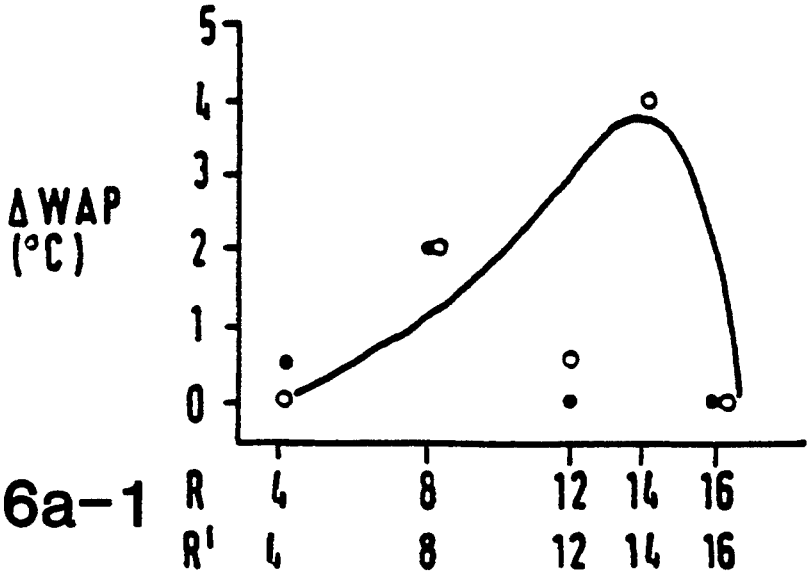
Figures 2, 6A:
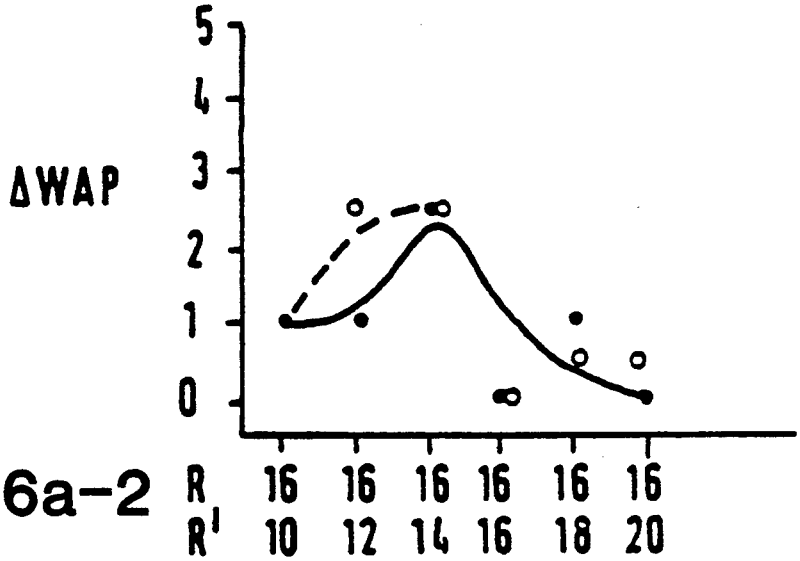
Figures 3, 6A:
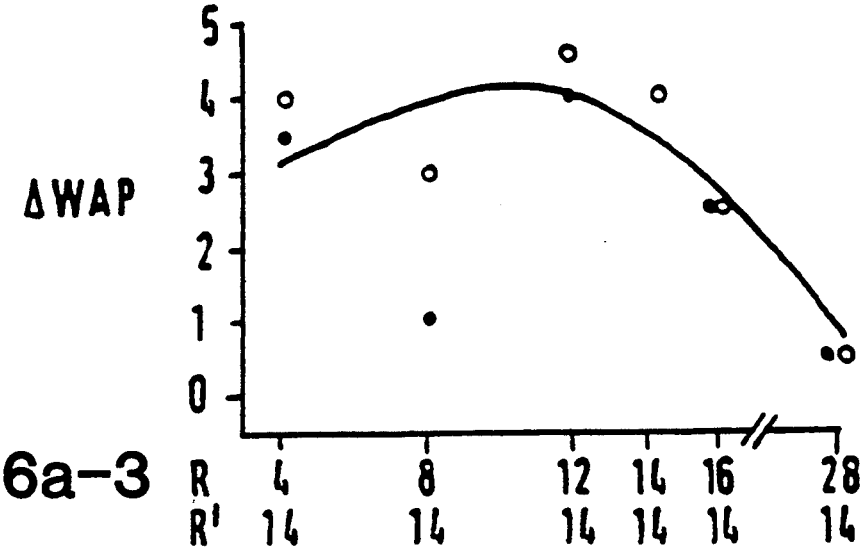
Figures 1, 6B:
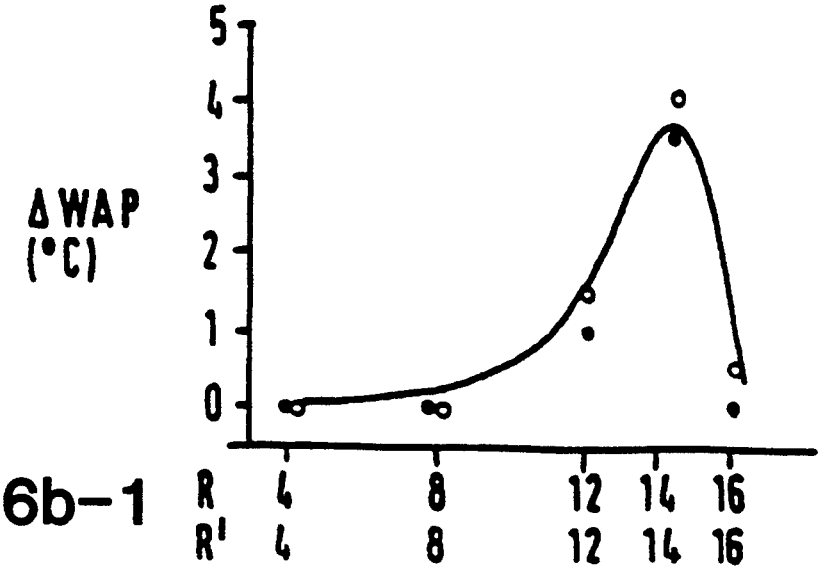
Figures 2, 6B:
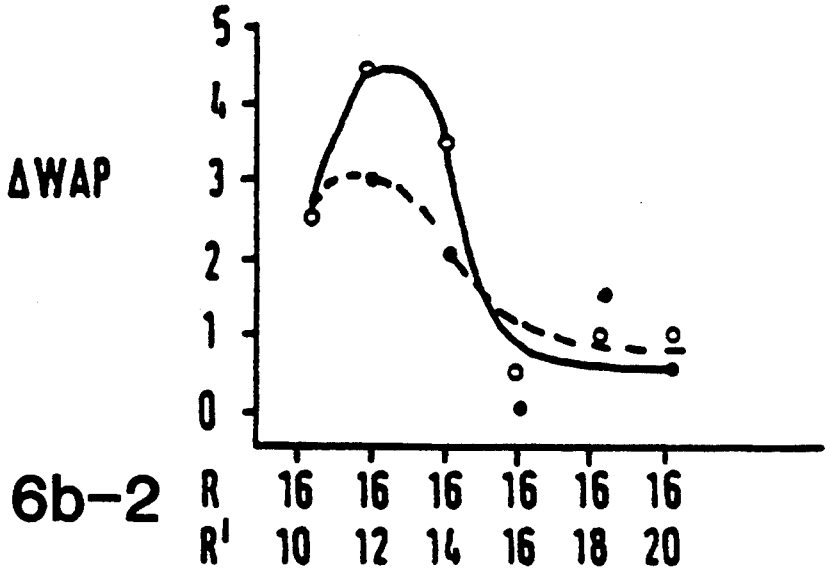
Figures 3, 6B:
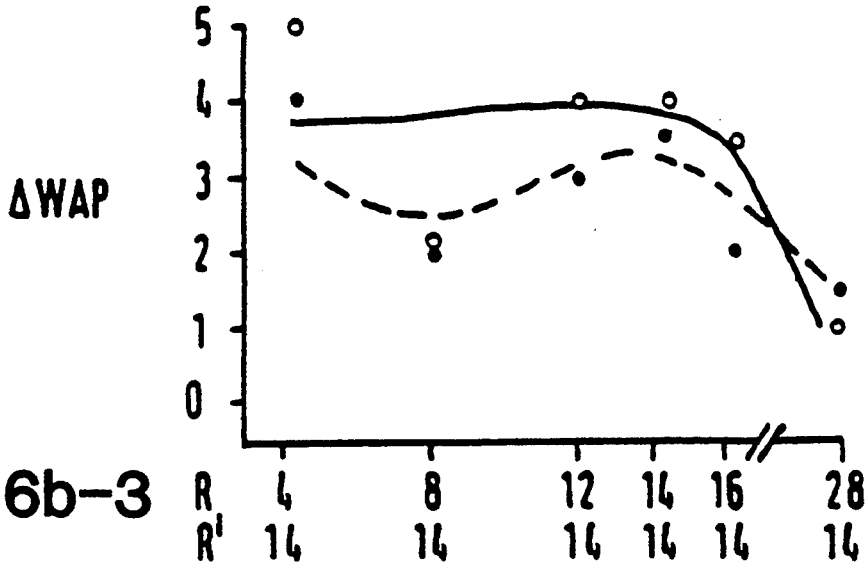
Figures 1, 6C:
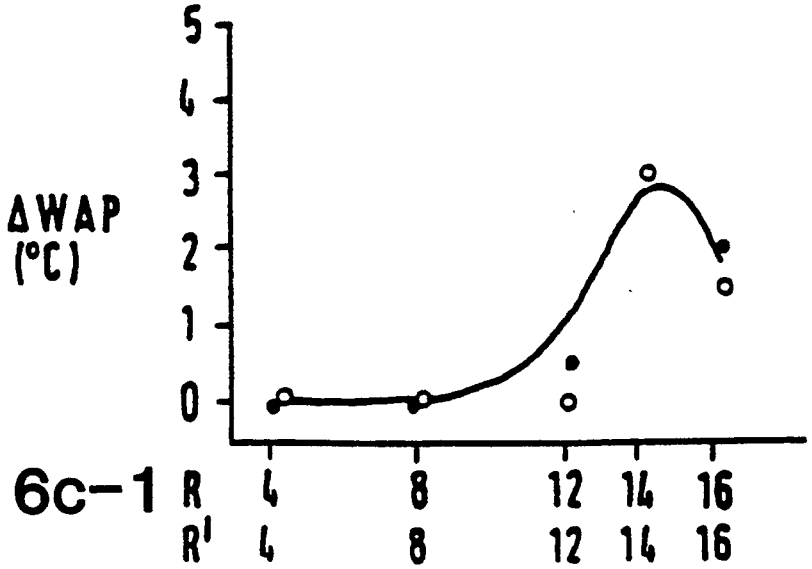
Figures 2, 6C:
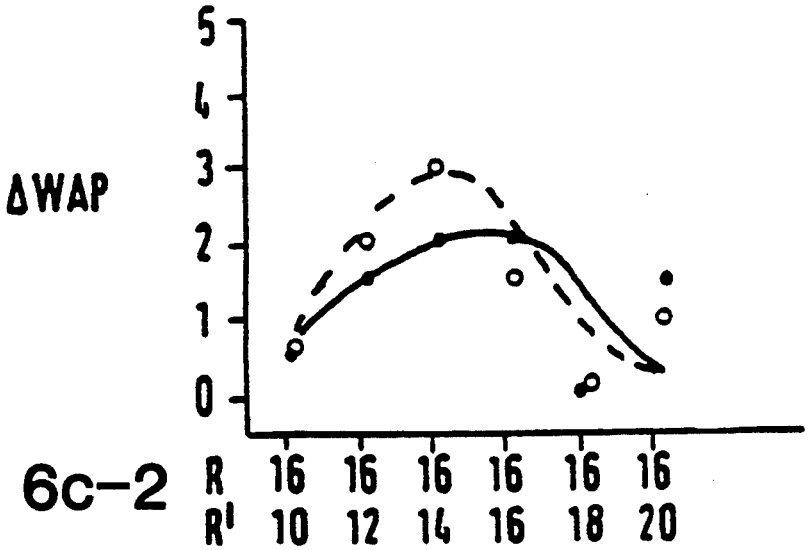
Figures 3, 6C:
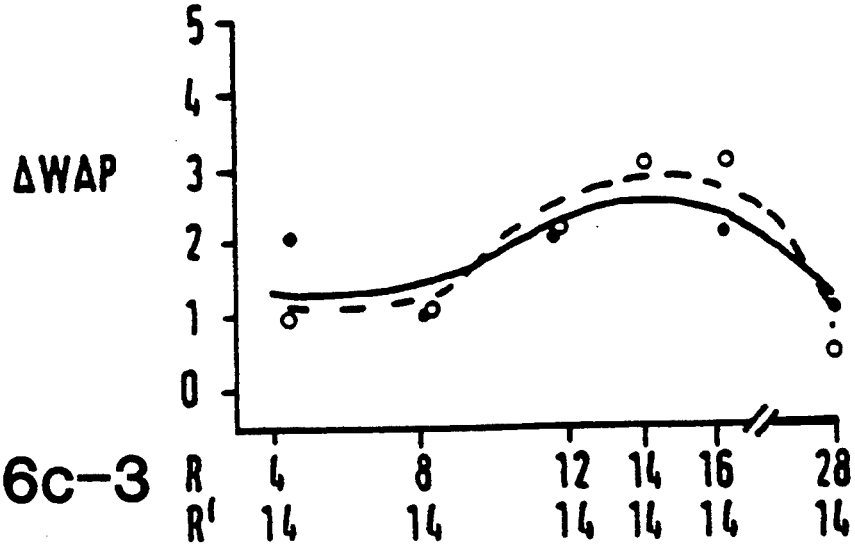
Figures 1, 6D:
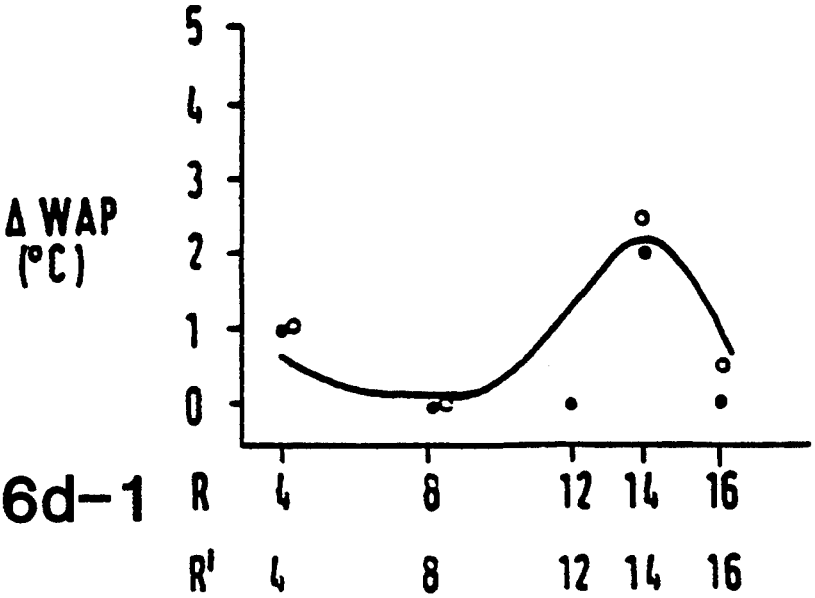
Figures 2, 6D:
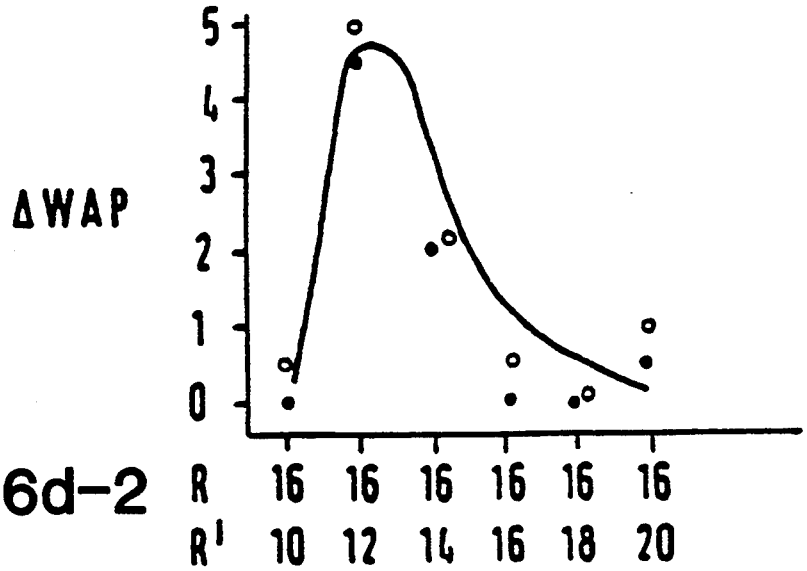
Figures 3, 6D:
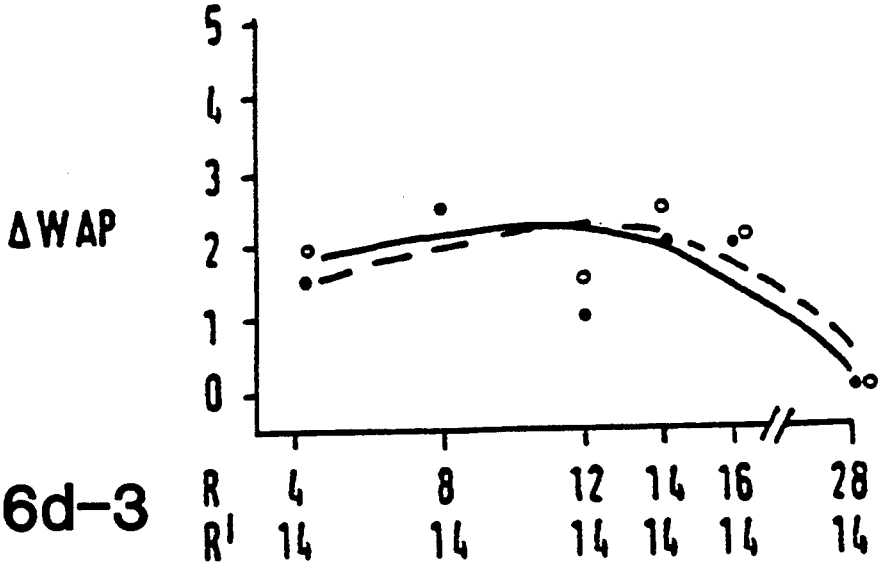

FIGS. 3(*a*) and (*b*) show the data for Table 3.

FIGS. 4(*a*) and (*b*) show the data for Table 4.

FIGS. 5(*a*) and (*b*) show the data for Table 5.

FIGS. 6(*a*), (*b*), (*c*) and (*d*) show the data for Table 6.

TABLE 1

CFPP and PCT performances for esterified olefin-maleate copolymers in Fuel A

| Olefin-maleate copolymer R | $R^1$ | treat ppm | Coadditive treat ppm | CFPP (°C.) Depression | PCT (mesh pass)[4] |
|---|---|---|---|---|---|
| — | — | — | — | 0 | 60 |
| 4 | 4 | 175 | — | 3 | 100 |
| 4 | 4 | 300 | — | 5 | 100 |
| 4 | 4 | 35 | 140 | 0 | 200 |
| 4 | 4 | 60 | 240 | 0 | 350 |
| 4 | 14 | 175 | — | 10 | 250 |
| 4 | 14 | 300 | — | 11 | 250 |
| 4 | 14 | 35 | 140 | 17 | 350 |
| 4 | 14 | 60 | 240 | 19 | 350 |
| 4 | 22 | 175 | — | 0 | 40 |
| 4 | 22 | 300 | — | 0 | 60 |
| 4 | 22 | 35 | 140 | 6 | 200 |
| 4 | 22 | 60 | 240 | 5 | 200 |
| 8 | 8 | 175 | — | 3 | 80 |
| 8 | 8 | 300 | — | 5 | 100 |
| 8 | 8 | 35 | 140 | 0 | 250 |
| 8 | 8 | 60 | 240 | 0 | 350 |
| 8 | 14 | 175 | — | 0 | 200 |

TABLE 1-continued

CFPP and PCT performances for esterified olefin-maleate copolymers in Fuel A

| Olefin-maleate copolymer R | $R^1$ | treat ppm | Coadditive treat ppm | CFPP (°C.) Depression | PCT (mesh pass)[4] |
|---|---|---|---|---|---|
| 8 | 14 | 300 | — | 11 | 250 |
| 8 | 14 | 35 | 140 | 16 | 350 |
| 8 | 14 | 60 | 240 | 19 | 350 |
| 8 | 18 | 175 | — | 0 | 60 |
| 8 | 18 | 300 | — | 1 | 60 |
| 8 | 18 | 35 | 140 | 13 | 60 |
| 8 | 18 | 60 | 240 | 18 | 80 |
| 12 | 12 | 175 | — | 4 | 120 |
| 12 | 12 | 300 | — | 4 | 150 |
| 12 | 12 | 35 | 140 | 0 | 250 |
| 12 | 12 | 60 | 240 | 1 | 250 |
| 12 | 14 | 175 | — | 3 | |
| 12 | 14 | 300 | — | 9 | |
| 12 | 14 | 35 | 140 | 18 | 350 |
| 12 | 14 | 60 | 240 | 18 | 350 |
| 12 | 16 | 175 | — | 3 | 120 |
| 12 | 16 | 300 | — | 4 | 150 |
| 12 | 16 | 35 | 140 | 19 | 60 |
| 12 | 16 | 60 | 240 | 20 | 80 |
| 14 | 12 | 175 | — | 0 | 100 |
| 14 | 12 | 300 | — | 0 | 100 |
| 14 | 12 | 35 | 140 | 13 | 250 |
| 14 | 12 | 60 | 240 | 14 | 350 |
| 14 | 14 | 175 | — | 4 | 200 |
| 14 | 14 | 300 | — | 7 | 250 |
| 14 | 14 | 35 | 140 | 20 | 350 |
| 14 | 14 | 60 | 240 | 21 | 350 |
| 16 | 10 | 175 | — | 1 | 200 |
| 16 | 10 | 300 | — | 1 | 200 |
| 16 | 10 | 35 | 140 | 16 | 250 |
| 16 | 10 | 60 | 240 | 20 | 350 |
| 16 | 12 | 175 | — | 10 | 250 |
| 16 | 12 | 300 | — | 12 | 350 |
| 16 | 12 | 35 | 140 | 20 | 350 |
| 16 | 12 | 60 | 240 | 21 | 350 |
| 16 | 14 | 175 | — | 2 | 200 |
| 16 | 14 | 300 | — | 4 | 250 |
| 16 | 14 | 35 | 140 | 19 | 200 |
| 16 | 14 | 60 | 240 | 22 | 200 |
| 16 | 16 | 175 | — | 0 | 60 |
| 16 | 16 | 300 | — | 1 | 60 |
| 16 | 16 | 35 | 140 | 18 | 80 |
| 16 | 16 | 60 | 240 | 19 | 80 |
| 16 | 18 | 175 | — | 0 | 30 |
| 16 | 18 | 300 | — | 0 | 30 |
| 16 | 18 | 35 | 140 | 15 | 100 |
| 16 | 18 | 60 | 240 | 16 | 100 |
| 16 | 20 | 175 | — | −2 | 20 |
| 16 | 20 | 300 | — | −2 | 20 |
| 16 | 20 | 35 | 140 | 13 | 250 |
| 16 | 20 | 60 | 240 | 15 | 250 |
| 16 | 22 | 175 | — | −1 | 20 |
| 16 | 22 | 300 | — | −2 | 30 |
| 16 | 22 | 35 | 140 | 12 | 250 |
| 16 | 22 | 60 | 240 | 15 | 250 |
| 28 | 14 | 175 | — | 0 | 40 |
| 28 | 14 | 300 | — | 1 | 40 |
| 28 | 14 | 35 | 140 | 3 | 200 |
| 28 | 14 | 60 | 240 | 4 | 350 |
| — | — | — | 175 | 3 | 100 |

TABLE 1-continued

CFPP and PCT performances for esterified olefin-maleate copolymers in Fuel A

| Olefin-maleate copolymer | | | Coadditive | | |
|---|---|---|---|---|---|
| R | $R^1$ | treat ppm | treat ppm | CFPP (°C.) Depression | PCT (mesh pass)[4] |
| — | — | — | 300 | 4 | 150 |

TABLE 2

CFPP and PCT performances for esterified olefin-maleate copolymers in Fuel B

| Olefin-maleate copolymer | | | Coadditive | | |
|---|---|---|---|---|---|
| R | $R^1$ | treat ppm | treat ppm | CFPP (°C.) Depression | PCT (mesh pass) |
| — | — | — | — | 0 | 60 |
| 4 | 4 | 375 | — | 0 | 30 |
| 4 | 4 | 625 | — | 0 | 30 |
| 4 | 4 | 75 | 140 | 12 | 100 |
| 4 | 4 | 125 | 240 | 14 | 120 |
| 4 | 14 | 375 | — | 6 | 40 |
| 4 | 14 | 625 | — | 6 | 60 |
| 4 | 14 | 75 | 140 | 11 | 100 |
| 4 | 14 | 125 | 240 | 14 | 120 |
| 4 | 22 | 375 | — | 2 | 30 |
| 4 | 22 | 625 | — | 2 | 30 |
| 4 | 22 | 75 | 140 | 12 | 100 |
| 4 | 22 | 125 | 240 | 14 | 120 |
| 8 | 8 | 375 | — | 0 | 30 |
| 8 | 8 | 625 | — | 0 | 30 |
| 8 | 8 | 75 | 140 | 14 | 120 |
| 8 | 8 | 125 | 240 | 14 | 150 |
| 8 | 14 | 375 | — | 2 | 30 |
| 8 | 14 | 625 | — | 3 | 30 |
| 8 | 14 | 75 | 140 | 15 | 100 |
| 8 | 14 | 125 | 240 | 15 | 150 |
| 8 | 18 | 375 | — | −2 | 30 |
| 8 | 18 | 625 | — | −2 | 30 |
| 8 | 18 | 75 | 140 | 11 | 60 |
| 8 | 18 | 125 | 240 | 8 | 60 |
| 12 | 12 | 375 | — | 0 | 40 |
| 12 | 12 | 625 | — | 0 | 40 |
| 12 | 12 | 75 | 140 | 14 | 120 |
| 12 | 12 | 125 | 240 | 16 | 150 |
| 12 | 14 | 375 | — | 1 | 40 |
| 12 | 14 | 625 | — | 2 | 60 |
| 12 | 14 | 75 | 140 | 13 | 120 |
| 12 | 14 | 125 | 240 | 13 | 150 |
| 12 | 16 | 375 | — | 0 | 40 |
| 12 | 16 | 625 | — | 0 | 40 |
| 12 | 16 | 75 | 140 | 10 | 60 |
| 12 | 16 | 125 | 240 | 10 | 60 |
| 14 | 12 | 375 | — | 0 | 40 |
| 14 | 12 | 625 | — | 0 | 40 |
| 14 | 12 | 75 | 140 | 14 | 100 |
| 14 | 12 | 125 | 240 | 14 | 200 |
| 14 | 14 | 375 | — | 0 | 40 |
| 14 | 14 | 625 | — | 1 | 80 |
| 14 | 14 | 75 | 140 | 10 | 80 |
| 14 | 14 | 125 | 240 | 12 | 100 |
| 16 | 10 | 375 | — | 0 | 30 |
| 16 | 10 | 625 | — | 0 | 30 |
| 16 | 10 | 75 | 140 | 13 | 120 |
| 16 | 10 | 125 | 240 | 16 | 150 |
| 16 | 12 | 375 | — | 3 | 30 |
| 16 | 12 | 625 | — | 4 | 40 |
| 16 | 12 | 75 | 140 | 13 | 120 |
| 16 | 12 | 125 | 240 | 14 | 200 |
| 16 | 14 | 375 | — | 2 | 40 |
| 16 | 14 | 625 | — | 3 | 60 |
| 16 | 14 | 75 | 140 | 14 | 80 |
| 16 | 14 | 125 | 240 | 13 | 120 |
| 16 | 16 | 375 | — | 0 | 30 |
| 16 | 16 | 625 | — | 1 | 30 |
| 16 | 16 | 75 | 140 | 14 | 80 |
| 16 | 16 | 125 | 240 | 12 | 80 |
| 16 | 18 | 375 | — | −2 | F |
| 16 | 18 | 625 | — | −1 | F |

TABLE 2-continued

CFPP and PCT performances for esterified olefin-maleate copolymers in Fuel B

| Olefin-maleate copolymer | | | Coadditive | | |
|---|---|---|---|---|---|
| R | $R^1$ | treat ppm | treat ppm | CFPP (°C.) Depression | PCT (mesh pass) |
| 16 | 18 | 75 | 140 | 14 | 200 |
| 16 | 18 | 125 | 240 | 18 | 200 |
| 16 | 20 | 375 | — | 0 | F |
| 16 | 20 | 625 | — | −1 | F |
| 16 | 20 | 75 | 140 | 13 | 150 |
| 16 | 20 | 125 | 240 | 19 | 200 |
| 16 | 22 | 375 | — | −2 | F |
| 16 | 22 | 625 | — | −2 | F |
| 16 | 22 | 75 | 140 | 14 | 120 |
| 16 | 22 | 125 | 240 | 18 | 200 |
| 28 | 14 | 375 | — | −1 | 20 |
| 28 | 14 | 625 | — | 1 | 20 |
| 28 | 14 | 75 | 140 | 15 | 120 |
| 28 | 14 | 125 | 240 | 17 | 150 |
| — | — | — | 375 | 10 | 100 |
| — | — | — | 625 | 13 | 120 |

TABLE 3

Δ WAT and Δ MPR Results for esterified olefin-maleate copolymers in Fuel A (300 ppm treat)

| Olefin-maleate copolymer | | | |
|---|---|---|---|
| R | $R^1$ | Δ WAT | Δ MPR |
| 4 | 4 | −0.1 | 0.12 |
| 4 | 14 | −0.2 | 0.40 |
| 4 | 22 | 0.2 | −0.88 |
| 8 | 8 | −0.1 | −0.2 |
| 8 | 14 | −0.1 | −0.04 |
| 8 | 18 | 4.1 | −1.0 |
| 12 | 12 | −0.1 | 0.08 |
| 12 | 14 | 0.9 | 0.2 |
| 12 | 16 | 3.1 | −0.4 |
| 14 | 12 | 0 | −0.24 |
| 14 | 14 | 1.7 | 0.2 |
| 16 | 10 | 0.2 | 0.3 |
| 16 | 12 | 0.9 | 0.24 |
| 16 | 14 | 3.5 | −0.32 |
| 16 | 16 | 4.2 | −1.2 |
| 16 | 18 | 2.8 | −1.72 |
| 16 | 20 | 2.4 | −1.56 |
| 16 | 22 | 2.4 | −1.60 |
| 28 | 14 | 2.4 | −0.88 |

TABLE 4

Δ WAT and Δ MPR results for esterified olefin-maleate copolymers in Fuel B (625 ppm treat)

| Olefin-maleate copolymer A | | | |
|---|---|---|---|
| R | $R^1$ | Δ WAT | Δ MPR |
| 4 | 4 | −0.2 | −0.08 |
| 4 | 14 | 0.3 | 1.92 |
| 4 | 22 | −1.1 | −0.4 |
| 8 | 8 | −0.2 | 0.08 |
| 8 | 14 | 0.1 | 0.08 |
| 8 | 18 | 1.4 | −1.2 |
| 12 | 12 | −0.3 | 0.16 |
| 12 | 14 | 0.9 | 2.8 |
| 12 | 16 | 2.0 | 2.5 |
| 14 | 12 | −0.4 | −0.48 |
| 14 | 14 | 1.5 | 3.44 |
| 16 | 10 | 0.4 | 0.64 |
| 16 | 12 | 1.0 | 1.72 |
| 16 | 14 | 2.4 | 0.8 |
| 16 | 16 | 3.1 | −0.92 |
| 16 | 18 | 1.7 | −1.72 |
| 16 | 20 | 1.4 | −1.68 |
| 16 | 22 | 1.3 | −1.32 |
| 28 | 14 | 1.4 | −0.08 |

TABLE 5

Δ WAT and Δ MPR results for esterified olefin-maleate copolymers in Fuel C (500 ppm treat)

| Olefin-maleate copolymer | | | |
|---|---|---|---|
| R | $R^1$ | Δ WAT | Δ MPR |
| 4 | 4 | 0.1 | −0.64 |
| 4 | 14 | −0.1 | 0.56 |
| 4 | 22 | 0.2 | −0.44 |
| 8 | 8 | −0.1 | −0.44 |
| 8 | 14 | −0.1 | |
| 8 | 18 | 2.4 | −3.84 |
| 12 | 12 | 0.1 | −0.24 |
| 12 | 14 | 0.5 | 0.56 |
| 12 | 16 | 1.9 | −0.84 |
| 14 | 12 | | |
| 14 | 14 | 1.1 | 1.16 |
| 16 | 10 | 0.2 | −0.56 |
| 16 | 12 | 0.6 | 0.32 |
| 16 | 14 | 0.9 | 0.16 |
| 16 | 16 | 2.3 | −1.84 |
| 16 | 18 | 2.1 | −5.24 |
| 16 | 20 | 1.5 | −5.44 |
| 16 | 22 | 1.2 | −4.44 |
| 28 | 14 | 2.3 | −1.04 |

TABLE 6

WAP Depression Results in 4 North American Fuels treated with olefin-maleate copolymers

| Olefin-maleate Copolymer | | Fuel | | | | | | | |
|---|---|---|---|---|---|---|---|---|---|
| R | $R^1$ | D | | E | | F | | G | |
| 4 | 4 | 0.5 | 0 | 0 | 0 | 0 | 0 | 1 | 1 |
| 4 | 14 | 3.5 | 4 | 4 | 5 | 2 | 1 | 1.5 | 2 |
| 4 | 22 | 1 | 3 | 2.5 | 0 | 2 | −1 | 1 | −2 |
| 8 | 8 | 2 | 2 | 0 | 0 | 0 | 0 | 0 | 0 |
| 8 | 14 | 1 | 3 | 2 | 2 | 1 | 1 | 2.5 | |
| 8 | 18 | 0 | 0 | 1 | 1 | 0 | 1 | 0 | 0 |
| 12 | 12 | 0 | 1.5 | 1 | 1.5 | 0.5 | 0 | 0 | |
| 12 | 14 | 4 | 4.5 | 3 | 4 | 2 | 2 | 1 | 1.5 |
| 12 | 16 | 2 | 3 | 2.5 | 3 | 2 | 2.5 | 1 | 1.5 |
| 14 | 14 | | 4 | 3.5 | 4 | | 3 | 2 | 2.5 |
| 16 | 10 | 1 | | | 2.5 | 0.5 | 0.5 | 0 | 0.5 |
| 16 | 12 | 1 | 2.5 | 3 | 4.5 | 1.5 | 2 | 4.5 | 5 |
| 16 | 14 | 2.5 | 2.5 | 2 | 3.5 | 2 | 3 | 2 | 2 |
| 16 | 16 | 0 | 0 | 0 | 0.5 | 2 | 1.5 | 0 | 0.5 |
| 16 | 18 | 1 | 0.5 | 1.5 | 1 | 0 | 0 | 0 | 0 |
| 16 | 20 | 0 | 0.5 | 0.5 | 1 | 1.5 | 1 | 0.5 | 1 |
| 28 | 14 | 0.5 | 0.5 | 1.5 | 1 | 1 | 0.5 | 0 | 0 |

We claim:

1. A narrow boiling point distillate fuel exhibiting at least one improved low temperature property containing at least one low temperature property improving additive composition consisting essentially of (A) 0.0001 to 0.5 wt. % of a copolymer of straight chain alpha-olefin and maleic anhydride esterified with an alcohol wherein said alpha-olefin is represented by the formula $$R—CH=CH_2$$

and the alcohol is represented by the formula:

$$R^1OH$$

where R and $R^1$ are independently selected from alkyl radicals with the proviso that (i) at least one of R and $R^1$ contains more than 10 carbon atoms (ii) the sum of the number of carbon atoms present in R and $R^1$ is from 18 to 38, and (iii) $R^1$ is linear or contains a methyl branch at the 1 or 2 position; and (B) ethylene-vinyl acetate.

2. A distillate fuel according to claim 1 containing 0.001 to 0.2 wt. % of the copolymer.

3. A distillate fuel according to claim 1 in which the sum of the number of carbon atoms present in R and $R^1$ is 20 to 32.

4. A narrow boiling point distillate fuel composition exhibiting at least one improved low temperature property containing at least one low temperature property improving effective amount of low temperature property improving additive composition consisting essentially of (A) 0.0001 to 0.5 wt. % of a copolymer of straight chain alpha-olefin and maleic anhydride esterified with alcohol, wherein said alpha-olefin is represented by the formula $$R—CH=CH_2$$

and said alcohol is represented by the formula $$R^1OH$$

wherein R and $R^1$ are independently selected from alkyl radicals, with the proviso that (i) at least one of R and $R^1$ contains more than 10 carbon atoms, (ii) the sum of the number of carbon atoms present in R and $R^1$ is from 18 to 38, and (iii) $R^1$ is linear or contains a methyl branch at the 1 or 2 position; and (B) 1 part by weight per from 0.05 to 20 parts by weight of (A) of coadditive selected from the group consisting of polyoxyalkylene esters, ethers, ester/ethers, ethylene unsaturated ester copolymers, polar nitrogen containing compound, and mixtures thereof.

5. The distillate fuel composition of claim 4 containing from 0.001 to 0.2 wt. % of said low temperature property improving additive.

6. The distillate fuel composition of claim 4 wherein in said low temperature property improving additive the sum of the number of carbon atoms present in R and $R^1$ is 20 to 32.

7. The distillate fuel composition of claim 4 wherein (B) is ethylene unsaturated ester copolymer.

* * * * *